US005882129A

United States Patent [19]

Nakayama

[11] Patent Number: 5,882,129

[45] Date of Patent: Mar. 16, 1999

[54] PAPER FEED METHOD AND APPARATUS FOR A PRINTER

[75] Inventor: Takumi Nakayama, Ishikawa, Japan

[73] Assignee: Pfu Limited, Ishikawa, Japan

[21] Appl. No.: 16,292

[22] Filed: Jan. 30, 1998

Related U.S. Application Data

[62] Division of Ser. No. 647,894, filed as PCT/JP95/02060 Oct. 6, 1995, Pat. No. 5,713,674.

[30] Foreign Application Priority Data

| | | | |
|---|---|---|---|
| Oct. 6, 1994 | [JP] | Japan | 6-270223 |
| Oct. 6, 1994 | [JP] | Japan | 6-270224 |
| Oct. 6, 1994 | [JP] | Japan | 6-270225 |
| Aug. 17, 1995 | [JP] | Japan | 7-209532 |
| Aug. 17, 1995 | [JP] | Japan | 7-209533 |
| Aug. 17, 1995 | [JP] | Japan | 7-209556 |
| Aug. 17, 1995 | [JP] | Japan | 7-209702 |

[51] Int. Cl.[6] ..... B41J 11/26

[52] U.S. Cl. ..... 400/618; 226/51

[58] Field of Search ..... 40/613.1, 611, 40/613, 613.2, 616, 616.1, 616.2, 617, 618; 226/36, 38, 49, 51

[56] References Cited

U.S. PATENT DOCUMENTS

| | | | |
|---|---|---|---|
| 3,722,655 | 3/1973 | Singer | 400/613.1 |
| 4,927,277 | 5/1990 | Niikawa . | |
| 4,974,974 | 12/1990 | Yoshida et al. . | |
| 4,988,226 | 1/1991 | Ito | 400/616.2 |
| 4,990,004 | 2/1991 | Kawahara et al. . | |
| 5,158,380 | 10/1992 | Havslaib et al. | 400/616 |
| 5,158,381 | 10/1992 | Inomata et al. | 400/618 |
| 5,172,137 | 12/1992 | Hongo et al. . | |
| 5,423,620 | 6/1995 | Tokairin | 400/618 |

(List continued on next page.)

FOREIGN PATENT DOCUMENTS

| | | |
|---|---|---|
| 57-99844 | 6/1982 | Japan . |
| 60-46282 | 3/1985 | Japan . |
| 61-111246 | 5/1986 | Japan . |
| 62-135384 | 6/1987 | Japan . |
| 62-216781 | 9/1987 | Japan . |
| 1-13430 | 3/1989 | Japan . |
| 1-176734 | 7/1989 | Japan . |
| 3-142267 | 6/1991 | Japan . |
| 3-169665 | 7/1991 | Japan . |
| 4-3748 | 1/1992 | Japan . |
| 4-13370 | 2/1992 | Japan . |
| 4-31071 | 2/1992 | Japan . |
| 4-77282 | 3/1992 | Japan . |
| 5-40246 | 5/1993 | Japan . |

*Primary Examiner*—Eugene Eickholt
*Attorney, Agent, or Firm*—Nikaido, Marmelstein, Murray & Oram LLP

[57] ABSTRACT

It is an object of the present invention to prevent a sheet of continuous-form paper from slackening when it is fed back in a printer capable of feeding both sheets of continuous-form paper and cut-form paper. According to the method for feeding back a sheet of continuous-form paper (6) of the present invention, in a paper feed unit including a pin feed device (7) arranged in an upstream of the continuous-form paper feed passage and also including a friction feed device (4, 5) in which both the pin feed device (7) and the friction feed device (4, 5) feed the sheet of continuous-form paper (6) and a circumferential speed of the friction feed device (4, 5) is a little higher than that of the pin feed device (7), a first amount of feed is set by which the sheet of continuous-form paper is not loosened between the friction feed device (4, 5) and the pin feed device (7) and also a second amount of feed is set which is larger than a difference between an amount of feed of the friction feed device (4, 5) and an amount of feed of the pin feed device (7) when the sheet of continuous-form paper is fed back by the first amount of feed, and the sheet of continuous-form paper is fed back by the first amount of feed when both the friction feed device (4, 5) and the pin feed device (7) are simultaneously reversed, and the friction feed device (4, 5) is normally rotated by the second feed amount under the condition that the pin feed device is stopped. The sheet of continuous-form paper (6) is fed back by repeating the above reverse and the normal rotation.'

3 Claims, 33 Drawing Sheets

U.S. PATENT DOCUMENTS 5,445,458 8/1995 Uchiyama .
5,468,076 11/1995 Hirano et al. .
5,474,391 12/1995 Andou et al. .
5,474,392 12/1995 Matsuoka .
5,476,328 12/1995 Hori .
5,499,876 3/1996 Hosokawa et al. .
5,529,405 6/1996 Breitenbach et al. .
5,541,626 7/1996 Hiramatsu et al. .
5,578,323 11/1996 Sakaino et al. .
5,602,571 2/1997 Suda et al. ..... 400/618

<INVENTION>

<PRIOR ART>

PAPER FEED METHOD AND APPARATUS FOR A PRINTER

CROSS REFERENCE TO RELATED APPLICATION

This application is a divisional of U.S. patent application Ser. No. 08/647,894, filed as PCT/JP95/02060 Oct. 6, 1995 now U.S. Pat. No. 5,713,674. The subject matter of this application is hereby incorporated by reference.

FIELD OF THE INVENTION

The present invention relates to a paper feed method and apparatus for a printer provided in an information processor in which a sheet of continuous-form paper and sheets of cut-form paper are used. The present invention also relates to a paper feed unit, which is provided in an information processor such as a printer, image scanner or facsimile device, for feeding sheets of paper stacked on a paper feed tray by a frictional force of a paper feed roller one by one. The present invention also relates to an adjusting device for adjusting a head gap between a platen and a printing head of the printer.

The present invention also relates to a printer having a sound insulating mechanism which insulates noise made by a noise source in the printer such as an impact head and also at having a sheet entrance through which a recording medium such as a recording sheet or a film sheet is supplied.

BACKGROUND ART

When a large amount of data is outputted from a printer provided in an information processor, sheets of continuous-form paper are usually used, because there is little possibility of the occurrence of a paper jam or a failure in feeding sheets of paper. On the other hand, sheets of cut-form paper are used in usual office work. Various documents, the amount of data of which is small, are output on the sheets of cut-form paper. When a sheet of continuous-form paper is to be changed in the printing process, the sheet of paper is reversely fed. In this case, it is necessary to prevent the sheet of paper from slackening.

There is provided a paper feed mechanism of a printer in which a drive roller is mounted on a printer body, and an idle roller is mounted on a paper guide detachably attached to the printer body, and the idle roller comes into pressure contact with the drive roller so as to feed sheets of paper. Since the sheet of continuous-form paper is fed by a tractor, that is, by the action of pins, it is sufficient to give a weak force to the idle roller so as to pull the sheets of paper. When the pushing force is strong, sprocket holes are damaged and the tractor is disengaged from holes. When thick sheets of cut-form paper such as postcards are used, it is necessary to increase a pushing force of the idle roller so as to prevent the occurrence of a slippage. Concerning the pushing force of the idle roller, sheets of continuous-form paper and cut-form paper are incompatible with each other. Therefore, it is necessary to change over the pushing force according to the type of sheets of paper.

When a line feed operation is conducted in a conventional printer, in order to ensure a sheet passage for feeding sheets of paper stably, an amount of the gap formed between a printing head and a platen is increased to a predetermined value. However, when sheets of continuous-form paper are processed, on which perforations are formed in the boundary between pages, the perforations protrude from a surface of the sheet of paper. In this case, the printing head is caught by the perforations in the process of line feed, and the accuracy of line feed is deteriorated.

When sheets of cut-form paper are fed, sheets of paper stacked on the paper feed tray are sent out one by one. As a means for sending out sheets of paper one by one, there is provided a paper feed roller which comes into contact with a surface of the stacked sheet of paper and rotates to send them one by one. This type paper feed roller is commonly used. In a business machine, sheets of paper of various widths are used. Accordingly, in order to feed sheets of paper of various widths by one paper feed unit, a plurality of relatively short roller pieces are mounted on one roller shaft in accordance with the widths of the sheets of paper.

In the case of a printer, an OCR (optical character reader) or an image scanner in which the printing position and reading position of information must be accurately set, and all sheets of paper of different widths are guided by a reference side guide arranged at a stationary position on the paper feed tray. In this case, the positions of the roller pieces mounted on the roller shaft are determined in accordance with the widths of the sheets of paper while the reference side guide is used as a reference. Accordingly, intervals of the roller pieces mounted on the roller shaft are not equal. In the paper feed unit arranged as described above, when sheets of paper of the maximum width are fed, all roller pieces come into contact with the sheet surface. When sheets of paper of small width are fed, only the roller pieces within the width come into contact with the sheet surface. In order to feed sheets of paper by the above paper feed unit without causing a skew feed, it is necessary for the plurality of roller pieces to come into contact with the sheet surface with the same pressure.

The sheets of recording paper stacked on a hopper of the printer are fed one by one as follows. The uppermost sheet of recording paper in the stack is fed by the paper feed roller provided at an upper portion of the hopper. In order to prevent the second and later sheets of paper from advancing together with the first sheet of paper at this time, a separating pad is usually arranged opposite to the paper feed roller. When the second sheet of paper advances between the paper feed roller and the separating pad together with the first sheet of paper, the second sheet of paper is blocked by friction force due to the separating pad. In this way, the uppermost first sheet of paper is separated from the second sheet of paper and successively conveyed by the paper feed roller. Then the first sheet of paper is received from the paper feed roller by the conveyance roller, and a printing operation is conducted on the first sheet of paper by the printing section. After the completion of the printing operation, when a printing command is given to the second sheet of paper, the paper feed roller is rotated again, and paper feed operation is conducted in the same manner as that of the first sheet of paper. This operation is repeated and printing is conducted on a predetermined number of sheets of paper.

However, from a time when the first sheet of paper is sent to the printing section by the paper feed roller to a time when the second sheet of paper starts to be fed by the paper feed roller, a leading end of the next sheet of paper is interposed between the paper feed roller and the separating pad. Accordingly, when printing operation is continuously conducted on the next sheet of paper, no problems may be encountered. However, when the sheets of paper are replaced with sheets of paper of different size after the completion of a printing job, the hopper must be removed from the printer. In this case, it is difficult to pick up the sheet of paper, the leading end of which is interposed between the paper feed roller and the separating pad.

In general, when sheets of paper stacked on a tray are separated from each other and automatically fed one by one, a phenomenon of double feed tends to occur in the case where thin sheets of paper are fed, and a failure in feeding tends to occur in the case where thick sheets of paper are fed. When copy sheets composed of a plurality of layers are fed, layers tend to be separated from each other by an increased paper feeding force. Therefore, in order to prevent the occurrence of double feed and separation between layers, the conventional automatic paper feed unit adopts the following means. A paper feed force to be used as a reference force is set at a low value. When thick sheets of paper are fed, it is impossible to feed the sheets by the force of low intensity. In this case, the intensity of the paper feed force is increased.

However, in the conventional structure, the pushing force of the paper feed roller given onto sheets of paper is changed by a plurality of steps: Therefore, a plurality of springs are required for adjusting the pushing force of the paper feed roller, and it is necessary to set the spring force for each spring. When the paper feed resistance is high, the paper feed roller is raised due to the high paper feed resistance. Therefore, it is necessary to provide a space in which the paper feed roller can to be raised upward. When sheets of paper of high paper feed resistance are fed, the following operation is required. After the paper feed roller has been stopped, the paper tray is further raised, and then the paper feed roller is started again to feed the sheets of paper. Therefore, the throughput of sheets of paper is lowered.

In the case of an impact printer having a noise source, noise is mainly caused by an impact head for printing in the printing operation. This noise caused by the impact head leaks outside the printer from the sheet entrance. Therefore, an operator and others feel uncomfortable. In order to solve the above problems, it is necessary to reduce a leakage of noise from the printer as much as possible. In order to attain the above object, the following countermeasures are taken. The sheet feed entrance is made to be small; sound absorbing material is arranged around the sheet entrance; and the impact head is covered with sound absorbing material.

However, problems may be encountered by the above counter measures. When the sheet feed entrance is made to be small and sound absorbing material is arranged close to the sheet feed entrance, the sheet passage becomes narrow, so that the occurrence of a sheet jam tends to occur. In order to solve the above problems, the following countermeasures are taken. There is provided a sound insulating cover attached to the sheet feed entrance, and this cover is made to be opened and closed. Therefore, when sheets of paper pass through the sheet feed entrance, a clearance of the passage is reduced so as to prevent noise from leaking outside. In the case of a sheet jam, the sound insulating cover is opened for jam clearance. However, the above countermeasure is disadvantageous in that the structure is complicated, and a highly sophisticated operation is required.

SUMMARY OF THE INVENTION

A first object of the present invention is to provide a simple technical means for preventing a sheet of continuous-form paper from slackening when it is fed back in a printer in which both sheets of cut-form paper and continuous-form paper can be fed and a pin type feed device for feeding sheets of continuous-form paper is arranged upstream of the continuous-form paper passage.

In order to realize the above object, the present invention provides a method for feeding back a sheet of continuous-form paper used in a paper feed unit including a pin feed means arranged in an upstream of the continuous-form paper feed passage and a friction feed means arranged in a downstream, wherein both the pin feed means and the friction feed means are capable of rotating normally and reversely, a circumferential speed of the friction feed means is a little higher than that of the pin feed means in both the normal and reverse rotation, the method for feeding back a sheet of continuous-form paper comprising the steps of: setting a first amount of feed by which a sheet of continuous-form paper is not loosened between the friction feed means and the pin feed means when the sheet of continuous-form paper is fed back by both the friction feed means and the pin feed means and also setting a second amount of feed which is larger than a difference between an amount of feed of the friction feed means and an amount of feed of the pin feed means when the sheet of continuous-form paper is fed back by the first amount of feed; feeding back the sheet of continuous-form paper by the first amount of feed when both the friction feed means and the pin feed means are simultaneously reversed; and normally rotating only the friction feed means by the second feed amount under the condition that the pin feed means is stopped.

In the above method for feeding back a sheet of continuous-form paper, the pin feed means and the friction feed means are driven by the same motor, and a mechanism to shut off the rotational transmission from the motor to the pin feed means is provided in the drive force transmission system, and the method for feeding back a sheet of continuous-form paper preferably comprises the steps of: reverse rotating the feed motor by the first amount of feed; shutting off the rotational transmission of the drive force transmission system; normally rotating the feed motor by the second amount of feed; connecting the rotational transmission of the drive force transmission system; and repeating the above motions.

Also, the present invention is to provide a paper feed unit comprising: a pin feed means arranged upstream of the continuous-form paper passage; a friction feed means arranged downstream of the continuous-form paper passage; a feed motor capable of rotating normally and reversely; a rotational transmission means for transmitting the rotation from the feed motor to the pin feed means and the friction feed means in such a manner that a circumferential speed of the friction feed means is a little higher than that of the pin feed means; a mechanism for shutting off the rotational transmission from the feed motor to the pin feed means; a means for setting a first amount of feed by which a sheet of continuous-form paper is not loosened between the friction feed means and the pin feed means when the sheet of continuous-form paper is fed back by both the friction feed means and the pin feed means and also setting a second amount of feed which is larger than a difference between an amount of feed of the friction feed means and an amount of feed of the pin feed means when the sheet of continuous-form paper is fed back by the first amount of feed; a means for detecting amounts of rotation of the feed motor corresponding to the first and the second amount of feed; and a means for controlling a change-over of the rotational direction of the feed motor and also controlling to shut off and connect the rotational transmission system in such a manner that the feed motor is normally rotated by a rotational amount corresponding to the second amount of feed after the feed motor has been reversely rotated by a rotational amount corresponding to the first amount of feed, and then the transmission system is connected, and the above operation is repeated.

When a continuous-form paper feed-back command (continuous-form paper withdrawal command) is given in the process of feeding sheets of continuous-form paper or changing over from sheets of continuous-form paper to sheets of cut-form paper, the sheets of continuous-form paper are fed back by both the pin type feed means and the friction feed means. When an amount of feed back is smaller than the first amount of feed, the feed back operation is completed as it is. When an amount of feed back is larger than the first amount of feed, the pin type feed means is stopped when the sheet of continuous-form paper is fed back by the first amount of feed, and the friction feed means is changed over to the normal rotation side. When the friction feed means is normally rotated by the second amount of feed, the sheet between the pin type feed means and the friction feed means is stretched again. When this operation is repeatedly conducted, a looseness of the sheet between the pin type feed means and the friction feed means caused when the sheet is fed back is successively absorbed before it is increased. Accordingly, it is possible to feed back the sheet of continuous-form paper by a required amount without causing a bend and disconnection of the sheet from the pins.

A second object of the present invention is to provide a mechanism by which a paper jam can be cleared and pressing operation of the idle roller can be changed over between the sheets of continuous-form paper and cut-form paper.

In order to realize the above object, the present invention is to provide a sheet feed structure of a printer comprising: a paper guide section detachably attached to the printer body; a frame member pivotally attached to the paper guide section, for rotatably supporting an idle roller opposed to a drive roller mounted on the printer body; a spring for pushing the idle roller to the drive roller, wherein the spring comes into contact with the frame member, the spring exceeds the frame member and extends to a lower side of the connecting means attached to the guide section that can be moved upward and downward; and a cam for moving the connecting means upward and downward, attached to the printer body, wherein a force of the spring to push the frame member is changed by driving the cam, so that a force of the idle roller to push the drive roller can be adjusted in accordance with a sheet of continuous-form paper and a sheet of cut-form paper.

Since the pressing force of the idle roller against the drive roller is changed in accordance with the thickness of a sheet of paper which is a recording medium, an appropriate intensity of tension is given to the sheet of paper between these rollers. Therefore, it is possible to prevent the occurrence of a paper jam.

It is possible to adopt a sheet feed structure of a printer in which the spring coming into contact with the frame member is composed of at least two spring components, and one of the spring components is separated from the frame member when the cam is driven. In this case, when one of the springs is separated from the frame member, only the other spring presses the idle roller against the drive roller, so that a load given to the drive roller can be reduced.

A third object of the present invention is to provide a printing gap adjusting device of a printer by which an appropriately high line feed accuracy can be provided even if sheets of paper having perforations such as sheets of continuous-form paper are processed, by setting an amount of gap in accordance with an amount of line feed in the process of line feed operation.

In order to realize this object, the present invention is to provide a gap adjusting device of a printer comprising: a paper conveyance means for conveying a sheet of recording paper between the platen and the printing head; a gap adjusting means for adjusting a gap between the platen and the printing head to be a predetermined printing gap in the process of printing and to be a gap larger than the predetermined printing gap in the process of line feed; a means for finding a line feed time from the start to the end of line feed; and a correcting means for correcting the gap in accordance with the line feed time.

When an amount of line feed is large, the gap is set at a large amount. On the contrary, when an amount of line feed is small, the gap is set at a small amount. Accordingly, even when a portion in which perforations are provided such as a sheet of continuous-form paper is subjected to line feed (page feed), it is possible to obtain a sufficiently large gap opening, and the printing quality can be maintained high.

A fourth object of the present invention will be described below. In order to feed a plurality of sizes of sheets of paper, a plurality of roller pieces are mounted on one roller shaft of a paper feed unit. In order to avoid the occurrence of a failure in picking up a sheet of paper or the occurrence of a skew feed originating from an unbalanced pressing force given onto the surface of a sheet of paper by each roller piece, sheets of paper of various sizes must be stably fed, so that the accuracy can be enhanced in the assembling process and the burden imposed upon a worker can be reduced in the adjusting work.

In order to realize the above object, the present invention is to provide a paper feed unit comprising a plurality of roller pieces, the length in the axial direction of each roller piece is short, mounted on one roller shaft, wherein these roller pieces come into contact with an upper surface of the sheet of paper stacked on a paper feed tray, and windows or recesses are formed on the paper feed tray at positions corresponding to the plurality of roller pieces. In the paper feed unit by which a plurality of types of sheets of paper of different widths can be fed, there are provided not less than 3 roller pieces, and usually, there are provided 4 to 6 roller pieces. The structure provided by the present invention is effective when a large number of types of sheets of paper are used. That is, the structure provided by the present invention is effective when the number of the roller pieces mounted on one roller shaft is large and the roller pieces are arranged at irregular intervals unsymmetrically. When the roller pieces are arranged along the front edge of the paper feed tray, the windows or recesses are open to the front edge of the paper feed tray and formed into U-shapes.

When the windows or recesses are arranged being opposed to the corresponding roller pieces in this way, in the case where the sheets of paper are strongly pressed by some roller pieces, the sheets of paper are locally bent, so that the pressing forces given by the roller pieces can be reduced. Since the sheets of paper are bent in this way, an interval between the roller shaft and the upper surface of the paper feed tray is shortened compared with a case in which the windows or recesses are not provided. Accordingly, the roller pieces, which tend to float, are strongly pressed against the sheets of paper.

This action is effective when the pressing forces of all roller pieces coming into contact with the sheets of paper are made to be equal with respect to the fluctuation of the pressing forces caused when the roller shaft is bent by the biased reaction force due to the error of flatness of the upper surface of the paper feed tray or due to the fluctuation of the pushing forces of the roller pieces caused at random. This action is also effective when the pressing forces of all roller pieces coming into contact with the sheets of paper are made to be equal in the case of feeding sheets of paper of small width.

Accordingly, the structure provided by the present invention is especially effective when the number of the roller pieces mounted on one roller shaft is large and the roller pieces are arranged at irregular intervals unsymmetrically. Further, in this structure in which the windows or recesses are arranged at the front edge portion of the paper feed tray being formed into U-shapes, the sheets of paper are sent out under the condition that they are bent onto the side of the windows or recesses.

Accordingly, the bent portions on the sheets of paper are not given a local resistance by the paper feed tray, and further the front edge portions of the sheets of paper are bent. Accordingly, the pressing forces of the roller pieces can be effectively made equal.

A fifth object of the present invention is to provide a paper feed unit of a printer in which a sheet of paper, the leading end portion of which enters a clearance between the paper feed roller and the separating pad, can be easily picked up, so that sheets of paper can be easily replaced.

The present invention is to provide a paper feed unit of a printer comprising: a hopper on which a large number of sheets of recording paper can be stacked; and a paper feed roller coming into contact with an upper surface of the front end of the uppermost sheet of paper stacked on the hopper, wherein the upper most sheet of paper is fed forward when the paper feed roller is rotated, and recesses are formed at the front end of the paper stacking region of the hopper and the depth of the recesses can be adjusted when the height of stacked sheets of paper is different in the transverse direction, so that the sheets of paper can be uniformly contacted with the paper feed roller.

Depending upon a recording medium, the thickness of the right edge portion and the thickness of the left edge portion are different from each other. However, there are provided recesses at the right and the left edge of the sheets of paper provided on the hopper. Accordingly, the contact pressure of the front end portion of the sheet of paper coming into contact with the paper feed roller is the same with respect to the center and both sides of the sheet of paper. Therefore, the sheets of paper can be smoothly fed and the occurrence of a skew feed can be prevented.

In this case, the following structure may be adopted. In the recess, there is provided a flap, and the height of the flap is automatically changed in accordance with an amount of sheets of paper stacked on the hopper. In this case, the height of the flap, that is, the depth of the bottom portion of the hopper is automatically raised and lowered, so that a predetermined pressure is always given to the sheets of paper by the paper feed roller irrespective of an amount of the sheets of paper.

A sixth object of the present invention is to provide a method of paper feed by which the occurrence of double feed of sheets of thin paper can be prevented and also provide a simple, compact automatic paper feed unit in which the above method of paper feed is used and further the throughput of sheets of paper can be improved.

According to this invention, after the paper feed roller, which is in a stop condition, has been temporarily pressed against the sheets of paper stacked on the paper feed tray, while the pressing force is being reduced, the paper feed roller is rotated so as to give a paper feed force onto the sheet of paper. In this way, the occurrence of double feed of sheets of thin paper can be prevented. In the case of an automatic paper feed unit in which the paper feed tray is raised and lowered so that the sheets of paper can be pressed against the paper feed roller, after the paper feed tray has been temporarily raised to a position at which the upper surface of the sheet of paper exceeds a reference paper feed position, while the paper feed tray is being lowered, the paper feed roller is rotated. In this way, the sheets of paper are fed by the above method. The paper feed roller starts rotating simultaneously with or immediately after the start of reduction of the pressing force of the paper feed roller. In the case of a structure in which the paper feed roller is pressed against the sheets of paper when the paper feed tray is raised, the paper feed roller starts rotating simultaneously with or immediately after the start of a lowering motion of the paper feed tray.

In the automatic paper feed unit of the present invention, the pressing force of the paper feed roller and the time at which the paper feed roller starts rotating are controlled by the above method, and when a load given to the paper feed roller is increased, a tangential force of the transmitting mechanism is given in a direction so that the pressing force of the paper feed roller against the sheets of paper can be increased. That is, in the case of a paper feed unit in which the paper feed roller is driven by means of driving a belt, a transmitting wheel and an idle wheel are arranged in such a manner that a tangential force of the belt wound around the transmitting wheel supported by the frame acts downward on the idle wheel supported by a member on which the paper feed roller is mounted. In the case of a paper feed unit in which the paper feed roller is rotated by a gear mechanism, an idle gear and an intermediate gear are arranged in such a manner that a tangential force given by the transmitting gear supported by the frame acts downward on a gear supported by a member (supporting lever in the example shown in the drawing) on which the paper feed roller is mounted.

The stacked sheets of paper are temporarily pressed by the paper feed roller, and the paper feed roller is rotated while the pressing force is being reduced, and a frictional paper feed force is given to one of the stacked sheets of paper. Due to the above operation, a ratio of the occurrence of double feed can be greatly reduced.

A seventh object of the present invention is to provide a head gap adjusting device capable of adjusting an amount of gap between the platen and the printing head at all times.

In order to realize the above object, the present invention is to provide a gap adjusting unit of a printer comprising: a platen; a printing head opposed to the platen; a gap adjusting means for changing a head gap between the printing head and the platen by rotating an eccentric shaft; a sensor for detecting the gap; a pulse motor for driving the eccentric shaft; a means for detecting a rotational angle of the pulse motor; a means for detecting a first rotational angle of the motor when a predetermined gap is detected in the case where the pulse motor is rotated in one direction and also detecting a second rotational angle of the motor when the predetermined gap is detected in the case where the pulse motor is rotated in the reverse direction; and a means for computing an intermediate angle of the first and the second motor so as to set the intermediate angle as an initial value. Accordingly, in the present invention, even when a cam sensor is not used, it possible to set an initial position easily.

The present invention is to provide a gap adjusting unit of a printer comprising: a platen; a printing head opposed to the platen; a medium conveyance means for conveying a printing medium between the platen and the printing head; a gap adjusting means for changing a gap between the printing head and the platen by rotating a cam; a pulse motor for driving the cam; a means for previously storing a relation between a rotational angle of the pulse motor and a position of the printing head on a table; a gap sensor for detecting a position at which the printing head or a reference surface for detecting a gap attached to a carrier mounted on the printing head comes into contact with the platen; a means for reading the table to find a rotational angle of the pulse motor corresponding to an amount of return when the printing head is returned from the contact position by a predetermined amount of gap; and a control means for rotating the pulse motor by a rotational angle corresponding to the amount of return.

According to the gap adjusting method described above, in accordance with an angle of the eccentric shaft when the gap sensor detects a gap, an amount of the pulse used for returning the printing head is varied. Accordingly, it is possible to obtain a constant head gap in the entire rotational region of the eccentric shaft irrespective of the thickness of the recording medium.

An eighth object of the present invention is to provide a parallelism adjusting mechanism used for a printing head of a printer capable of holding a predetermined parallelism of the printing head and the platen without increasing the mechanical strength of the frame to support the printing head and the platen.

In order to realize the above object, the present invention is to provide a parallelism adjusting unit of a printing head comprising: a platen; a carrier on which a printing head is mounted being opposed to the platen; a guide shaft for guiding the carrier so that the printing head can be moved in parallel with the platen; and an apparatus frame for holding the platen and the guide shaft to be parallel with each other, wherein the printing head is attached to the carrier, a member having a reference surface in the carrier advancing direction is attached to the carrier in such a manner that the member is contacted with the platen and capable of withdrawing from the platen, the parallelism of the printing head is computed in accordance with a difference of the movement of each member when the reference surface is pressed against the platen, and the position of the printing head is adjusted in accordance with the result of computation. Due to the above parallelism adjusting device of the invention, it is possible to maintain a predetermined parallelism at all times without using a strong frame made by means of sheet metal forming.

A ninth object of the present invention is to provide a printer having a sound insulating mechanism, in which a noise source is provided and a paper entrance is arranged, wherein a leakage of noise from the printer is reduced as small as possible by arranging a flap and a roller at positions close to the paper entrance, and a sheet of paper is not blocked by the flap and the roller when it passes through the paper entrance.

In order to realize the above object, the present invention is to provide a printer having a sound insulating mechanism to prevent noise generated by a noise source in the printer from leaking outside, comprising a paper feed entrance from which sheets of paper come in and out, the printer further comprising: a cover member used as a paper guide movably attached to the main body of the printer in such a manner that it can be moved between a paper guide position and a paper non-guide position; and a flap attached to the main body of the printer, wherein the cover member comes into contact with the flap and a closed passage through which sheets of paper can pass is defined when the cover member is set at the paper non-guide position, and the cover member is separated from the flap and an open passage through which sheets of paper come in and out is defined when the cover member is set at the paper guide position. Due to the foregoing, in accordance with a position at which the cover member is arranged, the size of the opening of the paper entrance can be changed. For example, it is possible to change a direction of conveyance of sheets of paper and it is also possible to replace an inlet with an outlet of sheets of paper when the apparatus is used in accordance with the types of sheets of paper, for example, sheets of continuous-form paper and cut-form paper.

In an embodiment of the present invention, the flap is composed as a portion of the printer casing made of-resin, so that the property of flexibility is given to the flap portion. In this case, the following arrangements may be adopted. The flap is attached to the printer body via a pivot, the flap comes into contact with the cover member by its weight when the cover member is disposed at the paper non-guide position, and a stopper is arranged so that a predetermined clearance can be provided between the paper guide and the flap when the cover member is disposed at the paper guide position.

In another embodiment, there is provided a spring between the flap and the printer body, wherein the flap is contacted with the cover member by a force generated by the spring when the cover member is disposed at the paper non-guide position. A lock means for maintaining the flap in an open condition may be provided. In this case, when the flap is opened in the case of sheets of thin paper, the occurrence of sheet jam can be easily prevented.

In another embodiment, a conveyance means is arranged at a position close to the paper entrance in the apparatus, wherein the conveyance means is composed of a pair of rollers, the lower roller is surrounded by a guide groove that is recessed downward from a paper feed surface, and the upper roller is surrounded by a sound insulating cover that covers an upper portion of the upper roller. In this case, the upper roller is pressed against the lower roller by its weight or the action of a spring, and the passage gap between the upper and the lower roller is automatically adjusted in accordance with the thickness of sheets of paper.

BRIEF DESCRIPTION OF THE DRAWINGS

FIGS. 1 to 4 are views to explain a method and an apparatus used when sheets of continuous-form paper are fed back when sheets of paper are changed in a printer in which both sheets of continuous-form and cut-form paper are used; wherein FIG. 1 is a side view showing a model of an example of the printer; FIG. 2 is a side view with a block diagram respectively showing a primary portion of the paper feed unit of the printer and its controlling system; FIG. 3 is a side view of the disengaging mechanism for disengaging a tractor; and FIG. 4 is a flow chart of the operation of withdrawal of sheets of continuous-form paper.

FIGS. 5, 6(*a*) and 6(*b*) are views of the paper feed mechanism of a printer of the present invention in which a pressing force of the idle roller against the drive roller can be changed over in accordance with sheets of continuous-form paper and cut-form paper; wherein FIG. 5 is a side view it showing an outline of the paper feed unit of the printer; FIG. 6(*a*) is a plan view of the pressing force change-over section; and FIG. 6(*b*) is a plan view showing a variation of the pressing force change-over section.

FIG. 9(*b*) is a flow chart of a conventional example showing a line feed operation conducted in the paper feed unit.

FIG. 10(*b*) is a front view of the primary portion of the embodiment of the present invention.

FIGS. 12 to 20 are views for explaining another embodiment of the sheet feed unit; wherein FIG. 12 is a block diagram showing a primary arrangement of the printer; FIG. 13 is a side view showing an outline of the paper feed unit; FIGS. 14(*a*) and 14(*b*) are flow charts showing a controlling operation conducted by the paper feed unit; FIG. 15 is a perspective view of the mechanism for shutting off power of the paper feed roller; FIGS. 16(*a*) to 16(*c*) are views for explaining an operation of the paper feed roller of the paper feed unit; FIG. 17 is a view showing the principle of the function of the hopper; FIG. 18 is a view showing an embodiment of the hopper; FIG. 19 is a view showing another embodiment of the hopper; and FIG. 20 is a view showing still another embodiment of the hopper.

FIGS. 21 to 24 are views for explaining still another embodiment of the paper feed unit; wherein FIG. 21 is a perspective view showing a model of the automatic paper feed unit; FIG. 22 is an overall perspective view of the paper feed unit; FIG. 23 is a flow chart showing an operation of the paper feed unit; and FIG. 24 is a schematic illustration showing a model of the double feed preventing action.

FIG. 25 is a schematic illustration of the head gap adjusting mechanism of a conventional printer; FIG. 26 is a view showing a relation between the rotational angle of a pulse motor and the head gap; FIG. 27 is a partial perspective view of the head gap adjusting mechanism of the embodiment; FIG. 28 is a view showing an initial adjusting method of the embodiment; FIG. 29 is a schematic illustration showing a head gap adjusting method in which the head gap is adjusted by the rotation of an eccentric shaft; FIG. 30 is a view showing a returning motion of the head gap conducted by the rotation of an eccentric shaft in the conventional printer (a predetermined pulse is returned in the conventional example); and FIG. 31 is a flow chart showing an adjustment of the head gap in the embodiment.

FIGS. 33 to 42 are views for explaining a printer having a sound insulating mechanism; wherein FIG. 33 is a partial cross-sectional view of the impact type printer having a sound insulating mechanism, wherein the cover member is closed so as to process sheets of continuous-form paper; FIG. 34 is a partial cross-sectional view showing the same impact type printer, wherein the paper guide which is a cover member is opened so as to process sheets of cut-form paper; FIG. 35(*a*) is a view showing a condition in which the cover member is closed by the sound insulating mechanism composed of a flap so as to process sheets of continuous-form paper; FIG. 35(*b*) is a view showing a condition in which the paper guide, which is a cover member, is opened so as to process sheets of cut-form paper; FIG. 36 is a view showing an embodiment of the sound insulating mechanism composed of a flap; FIG. 37 is a view showing another embodiment of the sound insulating mechanism composed of a flap; FIG. 38 is a view showing still another embodiment of the sound insulating mechanism composed of a flap; FIG. 39 is a view showing an embodiment of the sound insulating mechanism of the sheet conveyance section in which two rollers are used; FIG. 40 is a view showing another embodiment of the sound insulating mechanism of the sheet conveyance section in which two rollers are used; FIG. 41 is a view showing an embodiment of the sound insulating mechanism of the sheet conveyance section in which one roller is used; and FIG. 42 is a view showing another embodiment of the sound insulating mechanism of the sheet conveyance section in which one roller is used.

THE MOST PREFERRED EMBODIMENT FOR CARRYING OUT THE INVENTION

FIGS. 1 to 4 are views to explain a method and apparatus for feeding back sheets of continuous-form paper when the sheets of paper are changed in the paper feed means of a printer in which both sheets of cut-form paper and continuous-form paper are used.

Figure 1:
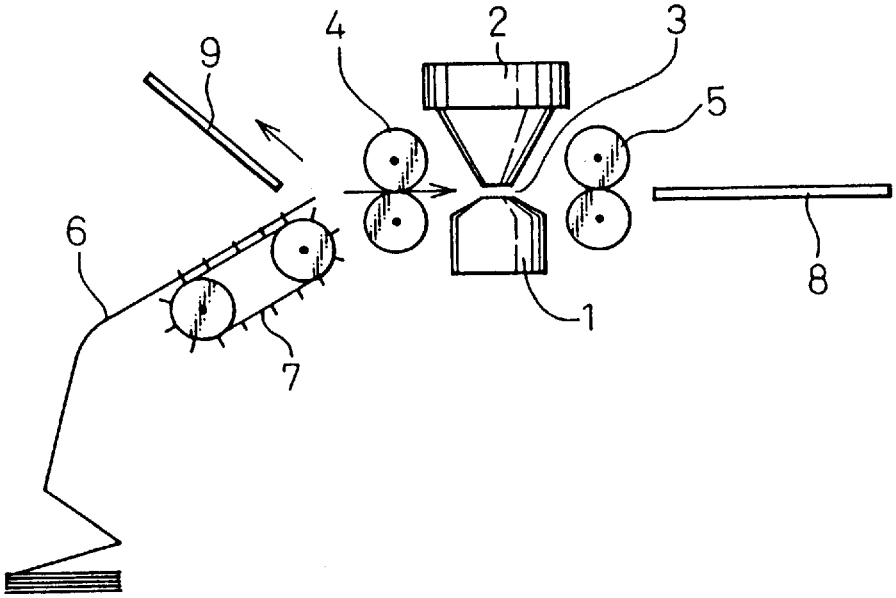

FIG. 1 is a schematic illustration showing an example of the printer used for an information processor. Due to the needs of business, this printer is capable of processing both sheets of continuous-form and cut-form paper. There is provided a printing section 3 composed of a platen 1 and a printing head 2. In the front and at the rear of the printing section 3, there is provided a frictional feed device composed of nip rollers 4, 5 between which a sheet of paper is interposed so as to be frictionally driven. Outside the nip roller 4, there is provided a pin-type feed device (tractor) 7 by which the sheet of continuous-form paper 6 is fed when the pins are driven. As is well-known, the tractor 7 feeds sheets of paper when the pins are engaged with feed holes (not shown) continuously formed on both sides of the sheets of continuous-form paper 6. In the apparatus shown in FIG. 1, while the sheets of continuous-form paper 6 are being fed from the left to the right, printing is conducted on them, and while the sheets of cut-form paper are being fed from the right to the left, printing is conducted on them. The sheets of cut-form paper are sent from a paper feed tray (or an automatic paper feed device) 8 shown on the right in FIG. 1. Then the sheets of cut-form paper are ejected to a stacker 9 shown on the left in FIG. 1. When necessary, between the stacker 9 and the nip roller 4 adjacent to it, or alternatively between the tractor 7 and the nip roller 4, there is provided a change-over mechanism for changing over the sheet passage.

In the printer shown in FIG. 1 in which the pin type feed device 7 is arranged in the upstream of the printing section 3, that is, in the upstream of the continuous-form paper passage, when the sheet of cut-form paper is processed, it is possible that the sheet of cut-form paper waits for the successive operation while a leading end of the sheet, which has been withdrawn from the printing section 3, is engaged with the pin type feed device 7. Accordingly, when the sheets of continuous-form paper and cut-form paper are frequently changed over, it is not necessary to disengage the sheet of continuous paper from the pin type feed device 7 each time. Therefore, the sheets can be quickly changed over.

However, when a sheet of continuous-form paper 6 is fed, it passes through the printing section 3 under the condition that no tension is applied to the sheet of continuous-form paper 6. Accordingly, there is a possibility of the occurrence of a sheet jam. Further, there is a possibility of deterioration of printing quality caused when the sheet floats or loosens. It is possible to solve the above problems as follows. When the sheet of continuous-form paper is fed, the nip roller 5 arranged in the downstream of the printing section 3, or alternatively both the nip rollers 4 and 5 lightly hold the sheet so that the sheet can be given a tension.

In order to simplify the structure and control of the sheet feed unit, usually, the nip rollers 4, 5 and the tractor 7 are synchronously driven by one feed motor. Therefore, in the synchronous driving operation, the circumferential speed of the nip rollers 4, 5 is set a little higher than the circumferential speed of the tractor 7 so that a tension can be given to the sheet of continuous-form paper to be fed.

In the process of feeding sheets of cut-form paper, it is necessary to maintain the sheet of continuous-form paper in a condition in which a leading end of the sheet of continuous-form paper is engaged with the tractor 7. Therefore, it is necessary to stop the tractor 7 when the sheets of cut-form paper are fed. For this reason, there is provided a connection release mechanism such as a clutch in the rotational drive system of the tractor 7, so that a torque can not be transmitted to the tractor 7 in the process of feeding sheets of cut-form paper.

When the sheet of continuous-form paper 6 is fed back in the above paper feed mechanism, as described above, the circumferential speed of the nip rollers 4, 5 is set a little higher than the circumferential speed of the tractor 7. Accordingly, the sheet is loosened between the nip rollers 4, 5 and the tractor 7. It is natural that an amount of looseness increases when an amount of feed-back of the sheet of paper is large. In this case, the sheet of paper is bent between the nip rollers 4, 5 and the tractor 7, and further the sheet of paper is disengaged from the tractor pins.

Figure 2:
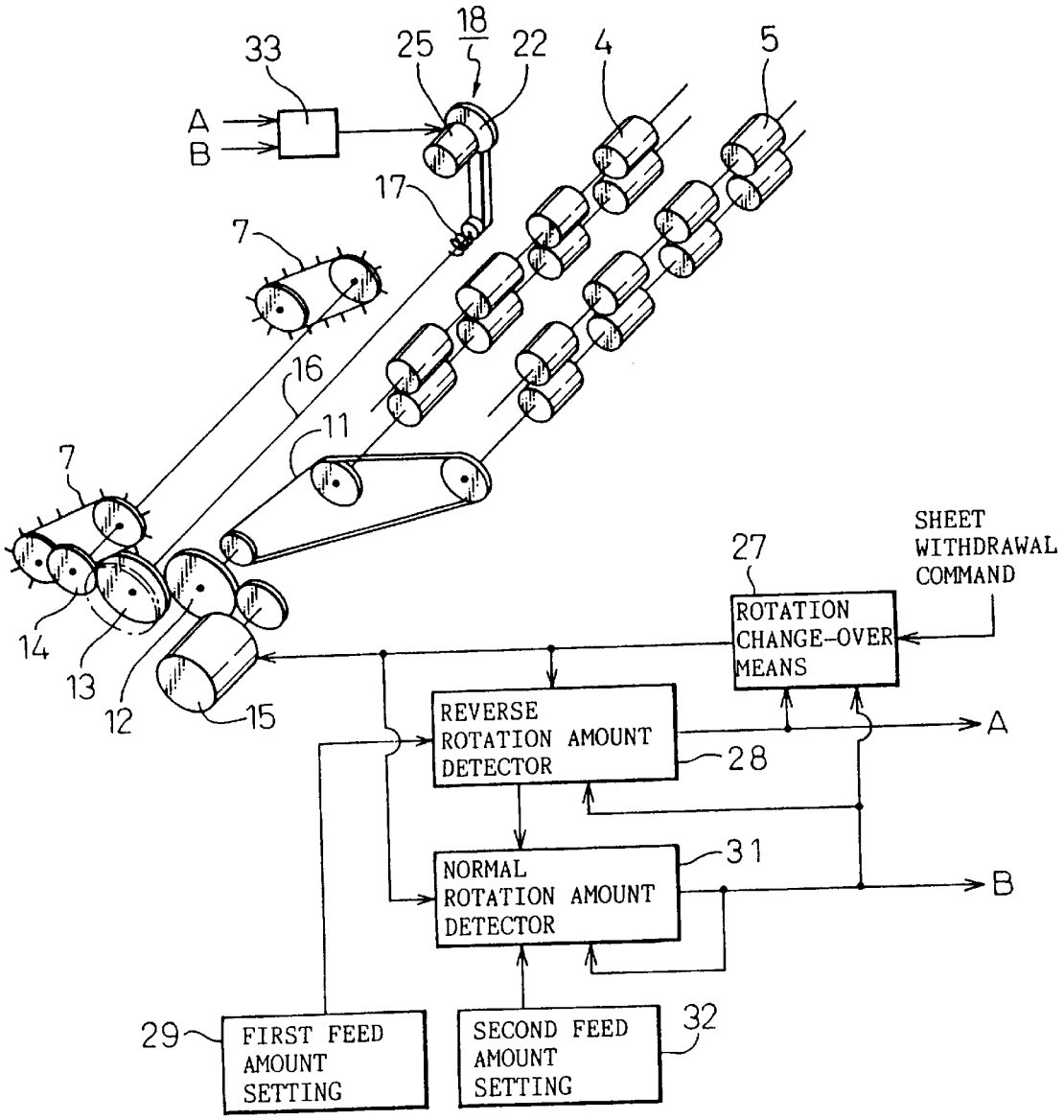

FIG. 2 is a schematic illustration showing an embodiment of the paper feed unit in which sheets of-paper are not loosened when the sheets of continuous-form paper are fed back. In FIG. 2, the platen 1, printing head 2, paper feed tray 8 and stacker 9, which are shown in FIG. 1, are omitted. The nip rollers 4 and 5 are simultaneously driven by a toothed belt 11 in the same direction. The tractor 7 is simultaneously driven in the same direction as that of the nip rollers 4, 5 via gears 12, 13, 14. The drive gear 12 and the toothed belt 11 are simultaneously driven by a feed motor 15. The intermediate gear 13 in the tractor drive system is mounted on an end of a slide shaft 16 slidably provided in the apparatus frame. The slide shaft 16 is pushed by a spring 17 in the returning direction, that is, in a direction in which the intermediate gear 13 can be engaged with the gears 12, 14. When the slide shaft 16 is moved by a disengaging mechanism 18 described later, the intermediate gear 13 is disengaged from the tractor gear 14, and the rotation of the tractor 7 is stopped. On the other hand, when the disengaging mechanism 18 returns to the original position, the slide shaft 16 returns by the action of the spring 17, and the intermediate gear 13 is engaged with the tractor gear 14 again.

Figure 3:
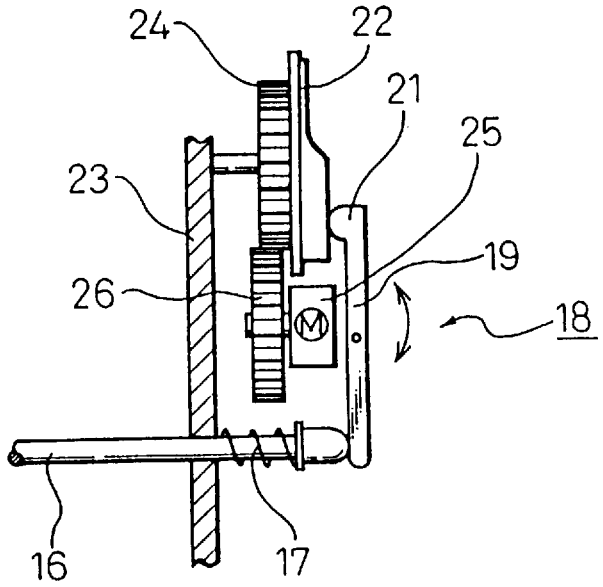

The detail of the disengaging mechanism 18 is shown in FIG. 3. By the pushing force of the spring 17, the slide shaft 16 comes into contact with the lower end of a seesaw lever 19, the center of which is pivoted on the apparatus frame. The upper end of the seesaw lever 19 is formed into a cam follower 21, and a disk cam 22 is arranged opposed to the cam follower 21. The disk cam 22 is rotatably attached to the frame 23. A gear 24 integrated with the disk cam 22 is engaged with a gear 26 attached to the disengaging motor 25. When the disengaging motor 25 is rotated, the disk cam 22 is rotated. When the seesaw lever 19 is oscillated clockwise in the drawing by the cam action of the disk cam 22, the slide shaft 16 is pushed into, and the intermediate gear 13 is disengaged from the gear 14 (and/or the gear 12). When the disk cam 22 is reversed, the seesaw lever 19 is oscillated and returned counterclockwise in FIG. 3, and the slide shaft 16 returns to the initial position by the pushing force of the spring 17, so that the intermediate gear 13 is engaged with the gear 14.

The feed motor 15 is a pulse motor. There is provided a normal and reverse rotation change-over means 27 in the control system of the pulse motor. When a reverse rotation pulse is sent from the normal and reverse rotation change-over means 27 to the feed motor 15, this pulse is counted by a reverse rotation amount detecting means 28. In the first feed amount setting means 29, an amount of feed back, which is determined to be in a range in which the sheet is not loosened, is previously set as an amount of feed back conducted by one motion. When the number of reverse rotation pulses counted by the reverse rotation amount detecting means 28 reaches the first feed amount which has already been set, the reverse rotation amount detecting means 28 sends a normal rotation command A to the normal and reverse rotation change-over means 27. Also, the reverse rotation amount detecting means 28 sends a count start command to the normal rotation amount detecting means 31. Due to the change-over from the reverse rotation to the normal rotation, the normal rotation pulses sent to the feed motor 15 are counted by the normal rotation amount detecting means 31. When a value counted by the normal rotation amount detecting means reaches the second feed amount that has been set in the second feed amount setting means 32, the normal rotation amount detecting means 31 sends a reverse rotation command B to the normal and reverse rotation change-over means 27, and values counted by the reverse rotation amount detecting means 28 and the normal rotation amount detecting means 31 are reset.

The normal rotation command A of the reverse rotation amount detecting means 28 is given to a controller 33 of the disengaging motor 25, and the disengaging motor 25 is rotated by a predetermined number of revolutions, so that the intermediate gear 13 is disengaged from the tractor gear 14. The reverse rotation command B sent from the normal rotation amount detecting means 31 is given to the controller 33 of the disengaging motor in the same manner, and the disengaging motor 25 is reversed by a predetermined number of revolutions, so that the intermediate gear 13 is engaged with the tractor gear 14.

Figure 4:
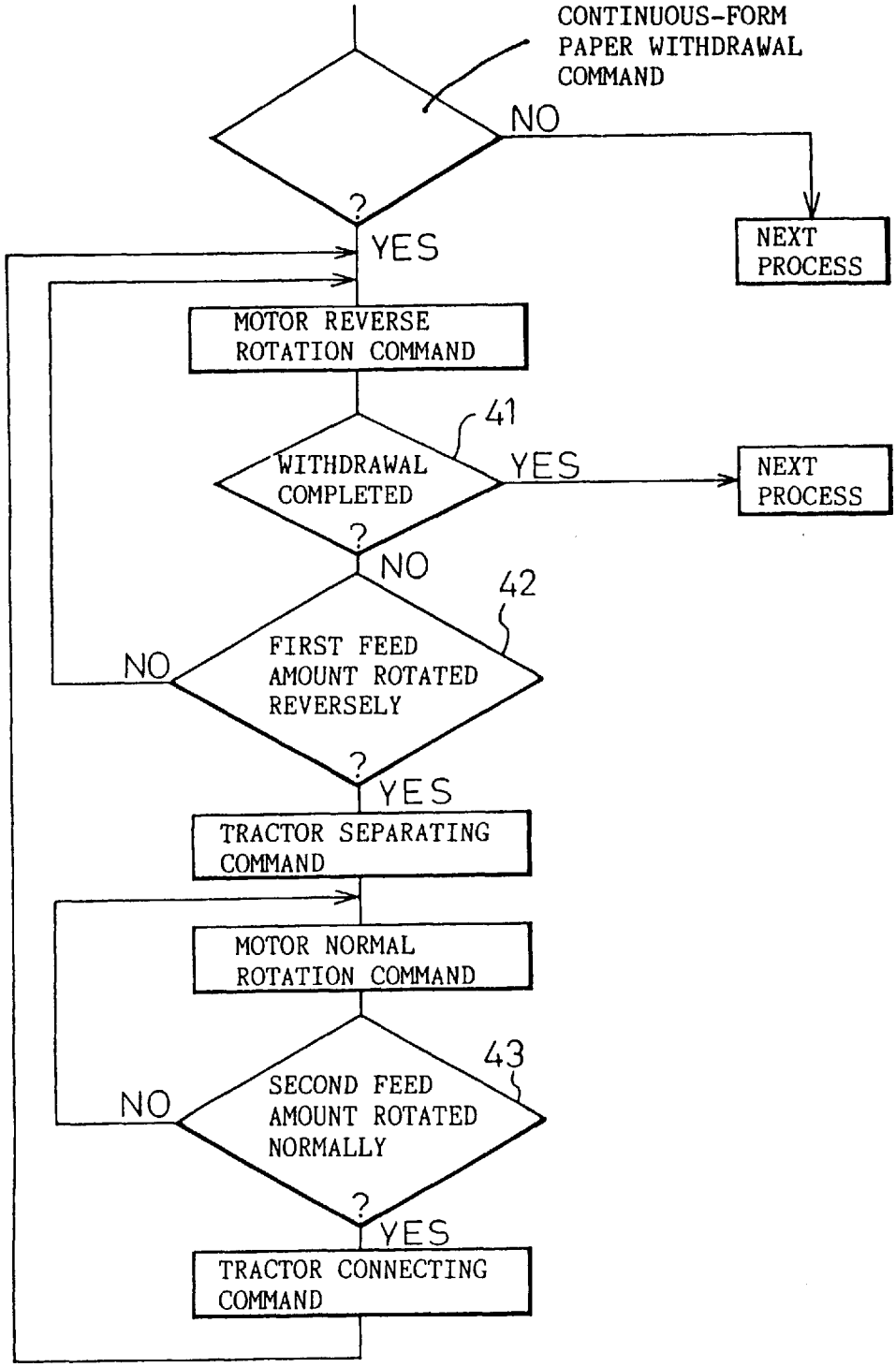

FIG. 4 is a flow chart showing the feed back method of sheets of continuous-form paper of this embodiment. When a continuous-form paper withdrawal command is inputted, a reverse rotation command is given to the feed motor 15. In step 41, it is judged whether or not the withdrawal of the continuous-form paper has been completed. When the withdrawal of the continuous-form paper has been completed, the continuous-form paper process is completed, and the program advances to the successive processing. It is possible to judge the completion of withdrawal by accumulating an amount of reverse rotation of the feed motor 15. When the withdrawal has not been completed, it is checked in step 42 whether or not the reverse rotation is conducted to the first feed amount. When the reverse rotation does not reach the first feed amount, the reverse rotation of the feed motor 15 is continuously conducted.

When the sheet of continuous-form paper is fed back to the first feed amount without reaching the completion of withdrawal, the tractor separation command is given, and then the normal rotation command is given to the feed motor 15. The normal rotation is continued until the rotation amount reaches the second feed amount. When the normal rotation amount reaches the second feed amount (step 43), a tractor connection command is given, and the feed motor 15 in is reversed again. As described above, until the withdrawal of the sheet of continuous-form paper 6 is completed, the feed motor 15 alternately repeats the reverse rotation of the first feed amount and the normal rotation of the second feed amount, so that the sheet of continuous-form paper 6 is fed back.

According to the embodiment explained above, the following effects can be provided. It is not necessary to open the frictional feed device when sheets of continuous-form paper are fed back. Therefore, it is not necessary to provide an opening and closing mechanism and its control unit of the frictional feed device. Accordingly, the structure of the paper feed unit can be simplified. In this way, it is possible to provide an inexpensive printer capable of processing both sheets of continuous-form and cut-form paper.

Next, referring to FIGS. 5, 6(*a*) and 6(*b*), a paper feed structure of the printer will be explained below, in which the pressing force of an idle roller against a drive roller can be changed over between sheets of continuous-form paper and cut-form paper.

Figure 5:
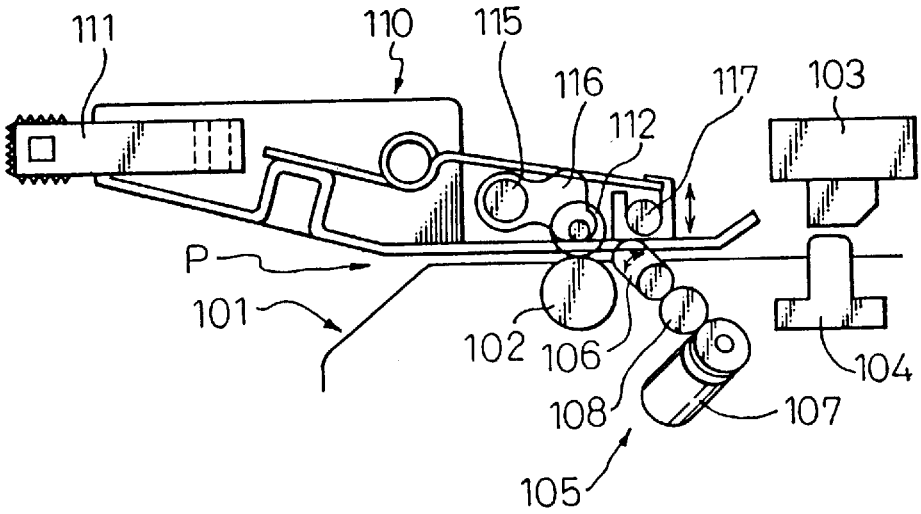

FIG. 5 is a side view of the paper feed mechanism of the printer.

On the side of the printer body (base frame) 101, there are provided a drive roller 102 for feeding sheets of paper, a printing head 103, a platen 104 and a cam mechanism 105 described later. The cam mechanism 105 includes a cam 106, a cam drive motor 107 and an intermediate gear 108.

There is provided a paper guide section 110 detachably attached to the main body 101. On both sides of the paper guide section 110, there are provided arms 111 used for detachably attaching the guide section 110 to the main body 101. Under the condition that the guide section 110 is attached to the main body 101, there is provided an idle roller 112 opposed to the drive roller 102, coming into contact with an upper side of the drive roller 102. This idle roller 112 is composed of a plurality of rollers, the number of which corresponds to the number of the drive rollers 102.

These idle rollers 112 are attached in the following 125 manner. As shown in FIGS. 5 and 6(*a*), there is provided a stationary shaft 115 in the guide section 110. On this stationary shaft 115, a plurality of covers or frame members 116 are pivotally mounted at intervals, and the idle roller 112 is rotatably attached to each frame member 116. When the guide member 110 is attached to the printer body 101, the idle rollers 112 are opposed to the drive rollers 102 on the printer body 101 side.

The spring 114 comes into contact with an upper side of the frame member 116. When the spring 114 presses the frame member 116 downward, the idle roller 112 is pressed against the drive roller 102. An end portion of the spring 114 extends and exceeds the frame member 116 and reaches an upper side of the shaft 117 of the guide section 110, and this shaft 117 is capable of moving upward and downward. On the lower side of the movable shaft 117, a cam 106 is arranged in such a manner that the cam 106 comes into contact with the movable shaft 117.

When sheets of continuous-form paper are fed, the operation is conducted as follows. The motor 107 is driven, so that the cam 106 is rotated clockwise in FIG. 5. Therefore, the movable shaft 117 is pushed upward, so that the spring 114 is pushed upward. Accordingly, the frame member 116 is not pushed by the spring 114. Due to the foregoing, a pressing force of the idle roller 112 against the drive roller 102 is reduced or eliminated. At this time, only the weight of the idle roller 112 including the weight of the upper frame member 116 acts on the drive roller 102.

When sheets of cut-form paper are fed, the motor 107 is reversed, so that the cam 106 is rotated counterclockwise in FIG. 5, and the movable shaft 117 is allowed to be lowered. Due to the foregoing, the spring 114 pushes the frame member 116 downward. Therefore, a pressing force of the idle roller 112 against the drive roller 102 can be increased.

Figure 6A:
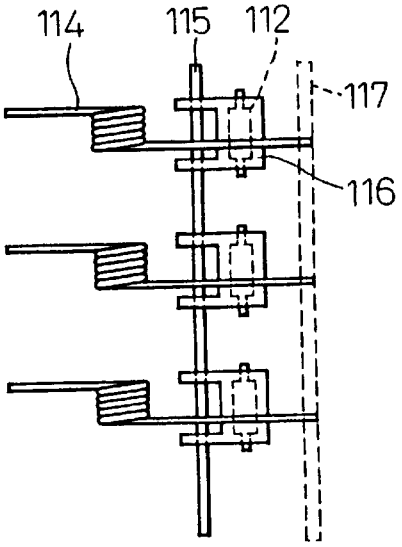
Figure 6B:
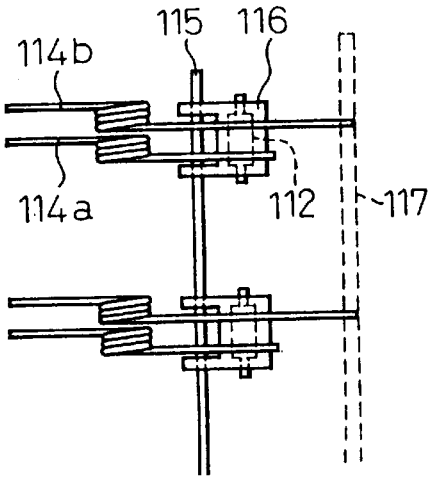

FIG. 6(*b*) is a view showing a part of the variation of the embodiment shown in FIG. 6(*a*). In this embodiment, there are provided two springs 114*a*, 114*b* for each frame member 116. One of the springs 114*a* is short and ends at a position of the frame member 116, however, the other spring 114*b* is long, so that an end of the spring 114*b* extends and exceeds the frame member 116 in the same manner as the embodiment described before. Therefore, the end of the spring 114*b* is located on the upper side of the movable shaft 117. On the lower side of this movable shaft 117, in the same manner as the embodiment described before, the cam 106 is arranged to come into contact with the movable shaft 117.

In this variation, the pressing force of the spring 114*a* always acts on the idle roller 112 via the frame member 116. Due to the foregoing, the idle roller 112 comes into contact with the drive roller 102 with a predetermined pressure.

When sheets of continuous-form paper are fed, when the movable shaft 117 is pushed up by the cam 106, the spring 114*b* is pushed upward, so that the spring 114*b* does not act on the frame member 116. In this case, only the pressing force of the other spring 114 acts on the idle roller 112. As a result, the pressing force of the idle roller 112 against the drive roller 102 can be reduced. When sheets of cut-form paper are fed, the movable shaft 117 is lowered by the action of the cam 106, so that the frame member 116 is pushed downward by both springs 114*a*, 114*b*. In this way, the pressing force of the idle roller 112 against the drive roller 102 can be increased.

Figure 7:
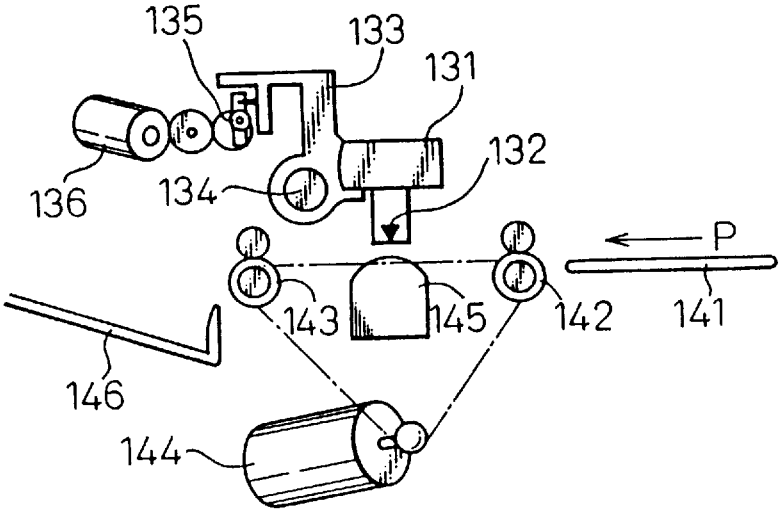
FIG. 7 is a side view showing an outline of another at embodiment of the paper feed unit of the printer.

FIG. 7 is a schematic illustration of the paper feed unit of a printer of another embodiment of the present invention. When a bankbook as shown in FIG. 8 is processed, an amount of line feed is corrected in accordance with a difference between the thickness of a front part of the folded portion and the thickness of a rear part when the folded portion passes through the paper feed unit.

In FIG. 7, reference numeral 131 is a printing head, reference numeral 132 is a paper detecting sensor, reference numeral 133 is a carriage on which the printing head 131 and the paper detecting sensor 132 are mounted, reference numeral 134 is a guide shaft on which the carriage 133 is moved, reference numeral 135 is an eccentric shaft, and reference numeral 136 is a pulse motor. Reference numeral 141 is a paper insertion ceiling plate, reference numerals 142, 143 are paper feed rollers, reference numeral 144 is a paper feed (LF) motor, reference numeral 145 is a platen, and reference numeral 146 is a stacker.

Figure 8:
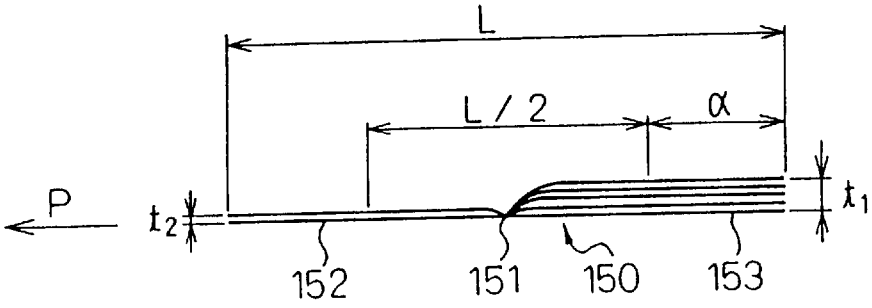
FIG. 8 is a view showing a bankbook.

As shown in FIG. 8, under the condition that the bankbook, which is a recording medium, is opened, the thickness $t_2$ of the front part 152 of the folded portion 151 is usually different from the thickness $t_1$ of the rear part 153. In the sheets of the bankbook 150, after the printing operation has been conducted on the front part 152, the printing operation is conducted on the rear part 153. When line feed is conducted while the folded portion 151 is being interposed between the lines, since the thickness of the front part 152 is different from the thickness of the rear part 153, it is necessary to change an amount of the gap formed between the printing head 131 and the platen 145. When line feed is conducted while the folded portion 151 is being interposed between the lines, due to the step between the front part 152 and the rear part 153, a load is imposed on the printing head 131 or an ink ribbon guide (not shown in the drawing), or alternatively the sheets are curled at the folded portion. Due to the foregoing, it is impossible to obtain an appropriate amount of line feed.

This embodiment includes a mechanism in which a motor 136 is rotated in accordance with the thickness of sheets of paper, and an amount of the gap is automatically adjusted via an eccentric shaft 135 rotated by the motor 136. The aforementioned gap amount adjusting mechanism is well known and disclosed in Japanese Unexamined Patent Publication No. 6-166238. Therefore, the detailed explanation of the mechanism will be omitted here.

In this embodiment, explanations are made for the correction of a line feed amount that is conducted in accordance with the step formed between the front and the rear of the sheets of the bankbook 150.

First, the bankbook 150 is inserted in the direction of arrow P along the upper surface of the sheet inserting section ceiling 141 of the printer. Then the paper feed motor 144 is rotated in the normal direction, and the sheets of the bankbook 150 are fed in the normal direction of arrow P by the paper feed rollers 142, 143. Then a front end portion of the sheets of the bankbook is detected by a paper detecting sensor 132 arranged close to the printing head 131. When the rear end portion of the sheets of continuous-form paper is detected by the paper detecting sensor 132, the motor 144 for paper feed (LF) is stopped. In this way, the length L of the sheets of the bankbook is recognized.

Next, the motor 144 for paper feed (LF) is reversed, so that the sheets of continuous-form paper 150 are withdrawn by a distance $\alpha$ ($\alpha<L/2$). At this time, LF motor 144 is stopped, and the paper thickness $t_1$ at the rear end 153 of the sheets of the bankbook 150 is detected.

Next, LF motor 144 is reversed, and the sheets of the bankbook 150 are further withdrawn by a distance L/2. At this time, LF motor 144 is stopped, and the paper thickness $t_2$ at the front 152 of the sheets of the bankbook 150 is detected.

Next, LF motor 144 is further reversed until the paper detecting sensor 132 detects the front end of the sheets of the bankbook 150, and then LF motor 144 is temporarily stopped.

Next, LF motor 144 is normally rotated until the paper detecting sensor 132 detects a printing start line of the front portion 152 of the sheets of continuous-form paper 150, and then the printing operation is started.

When the printing operation and the line feed operation are repeated, the front part 152 of the bankbook 150 is processed. When the line feed operation is conducted while the folded portion 151 is being interposed between lines, the following line feed correction amount is added to the line feed operation so as to carry out the line feed operation.

$$\text{Amount of line feed correction}=t_1-t_2/t_0\times X$$

In the above expression, X is an amount of line feed correction when the step formed between the front and the rear portion is $t_0$. The value of X is found by experiments in accordance with the type and thickness of the sheets of the bankbook.

After the completion of line feed operation, the rear part 153 of the sheets of the bankbook 150 is processed. In this way, the printing motion is completed.

Figure 9A:
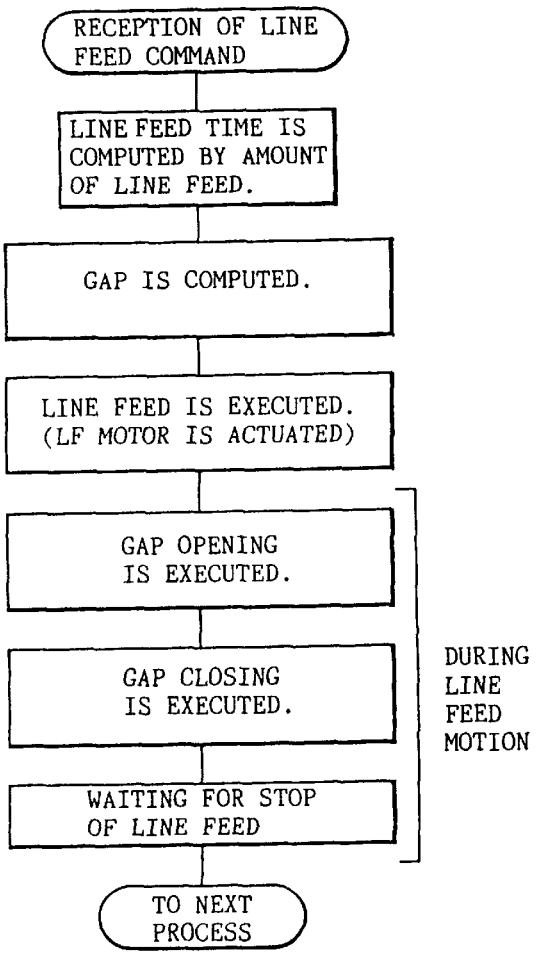
FIG. 9(*a*) is a flow chart of an embodiment showing a line feed operation conducted in the paper feed unit shown in FIG. 7.
Figure 9B:
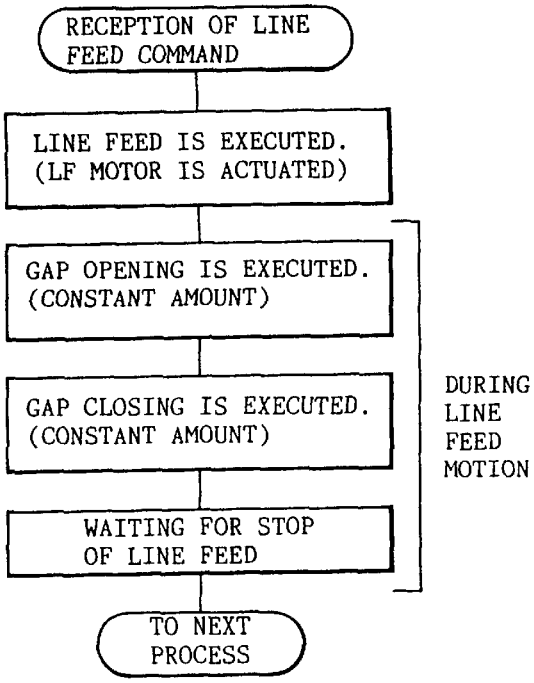

FIG. 9(*a*) is a flow chart of the paper feed unit of the printer of still another embodiment of the present invention. FIG. 9(*b*) is a flow chart of the conventional example corresponding to the above flow chart.

When sheets of continuous-form paper or cut-form paper are processed by the printer shown in FIG. 7, as shown in FIG. 9(*b*) in which a conventional example is illustrated, the line feed motion is conducted in such a manner that an amount of the gap formed between the printing head and the platen is extended by a predetermined mount so as to feed sheets of paper stably by ensuring a sheet passage. However, when protrusions of the perforations formed on sheets of continuous-form paper are large, the printing head is caught by the protrusions in the process of line feed in which the line is fed to the first line on the next page. Therefore, the line feed accuracy is deteriorated.

In order to solve the above conventional problems, the line feed accuracy is enhanced in this embodiment as follows. When an amount of line feed is large, for example, when the line is fed to the first line on the next page, an amount of the gap formed between the printing head and the platen is increased, and in the case of a usual line feed motion, an amount of the gap is reduced. When the amount of the gap is changed in accordance with an amount of line feed as described above, even if the protrusions of perforations on sheets of continuous-form paper are large, the sheet passage can be ensured and the line feed accuracy can be enhanced.

As shown on the flow chart of FIG. 9(*a*), the line feed motion is conducted as follows.

(1) Line feed data is received from a host computer.

(2) When a line feed motion is executed, the line feed time is computed in accordance with the line feed executing time, and LF motor is set in motion.

(3) In the process of the line feed motion, an amount of the gap between the printing head and the platen is determined in accordance with the line feed executing time computed in item (2), and then the pulse motor 136 for driving the cam shown in FIG. 7 is driven. Due to the foregoing, the carriage 133 is rotated counter-clockwise around the guide shaft 134, and a gap between the platen 145 and the printing head 131 is set in an open condition.

(4) After the gap opening motion has been completed, in order to start a gap closing operation in which the gap is closed by the same amount as that of the gap which has been opened, the pulse motor 136 is reversed. The above motion is also executed in the line feed motion.

(5) When the line feed motion is completed, the gap opening/closing motion is also completed. Therefore, the gap between the printing head and the platen is set in the same condition as that before the start of the line feed motion.

When the gap is opened and closed as described above, even in the case of sheets of continuous-form paper, the protrusions of perforations of which are large, the sheet passage can be ensured and the line feed accuracy can be enhanced. Further, while the line feed motion is being conducted, the gap opening/closing operation is executed. Therefore, it is possible to enhance the line feed accuracy without deteriorating the performance of the paper feed unit.

Figure 10A:
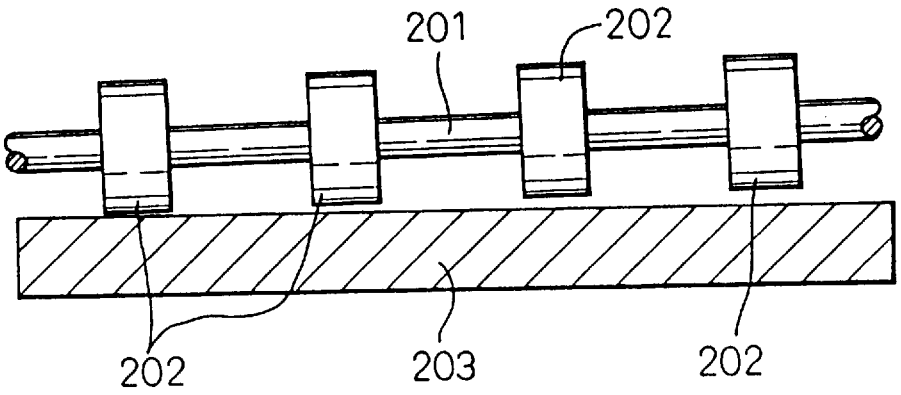
Fig.10(a) (PRIOR ART)
FIGS. 10(*a*), 10(*b*) and 11 are views of the paper feed unit by which sheets of paper stacked on a paper feed tray are sent out one by one; wherein FIG. 10(*a*) is a front view of the primary portion of the conventional example.
Figure 10B:
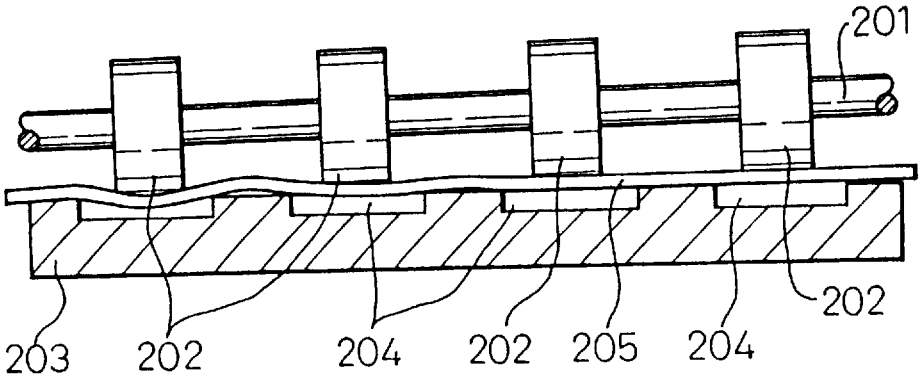

FIGS. 10(*a*), 10(*b*) and 11 are views showing a paper feed unit by which sheets of paper stacked on a sheet feed tray are fed one by one.

In this type paper feed unit, in order to feed sheets of paper without the occurrence of a skew feed, it is necessary that a plurality of roller pieces arranged in the sheet width are pressed against a surface of the sheet with the same pressure. For example, as shown in FIG. 10(*a*) in which a conventional example is illustrated, due to the errors caused in the process of assembling the roller shaft 201 and the paper feed tray 203, the parallelism of the roller shaft 201 and the paper feed tray 203 is not correct. In the above arrangement, the roller piece on one side is strongly pressed against the sheet surface, and the roller piece on the other side floats on the sheet surface so that the pressing force is reduced. Accordingly, the sheet feeding force is not well balanced, and sheets of paper stacked on the lower layer can not be fed appropriately, and further there is a tendency of the occurrence of a skew feed.

FIG. 10(*b*) is a front view showing a model of the primary portion of the paper feed unit of the embodiment of the present invention. A plurality of roller pieces 202 are mounted on one roller shaft 201. On an upper surface of the paper feed tray 203, there are provided a plurality of recesses 204 respectively opposed to the plurality of roller pieces 202. The width of each recess 204 is smaller than the width of the opposing roller piece 202. Consequently, when the sheets of paper 205 are strongly pressed by some roller pieces 202, they are bent toward the recesses 204, so that the pressing forces of the roller pieces concerned can be reduced. Since the sheets of paper 205 are bent, a distance from the roller shaft 201 to the upper surface of the paper feed tray is shortened. Accordingly, the roller pieces located on the right in FIG. 10(*b*), which tend to float on the sheet surface, are made to positively come into contact with the sheet surface.

Figure 11:
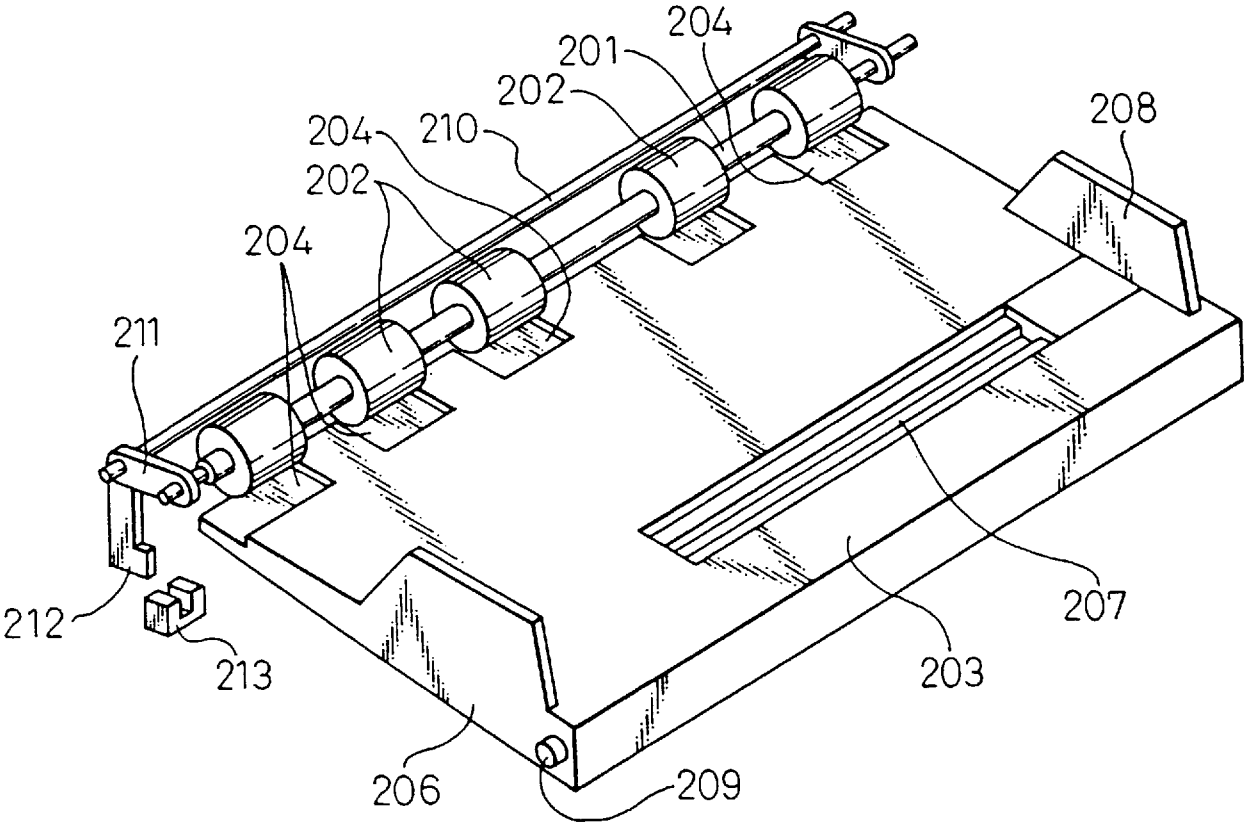
FIG. 11 is a perspective view of a more specific embodiment.

FIG. 11 is a perspective view showing a more specific embodiment. In the embodiment shown in FIG. 11, five roller pieces 202 are mounted on one roller shaft 201 at irregular intervals. At the front edge portion of the paper feed tray 203, there are formed recesses 204, the shapes of which are formed into C-shapes when a view is taken on the plane, and each recess is located at a position corresponding to each roller piece 202. On the viewer's side of the paper feed tray 203 in the drawing, there is provided a reference side guide 206 which is fixed to the paper feed tray 203. On the opposite side to this reference side guide 206, there is provided a movable side guide 208 capable of moving along the guide groove 207 in the sheet width direction.

Sheets of paper of narrow width are fed by two or three roller pieces provided on the viewer's side in FIG. 11, and sheets of paper of wide width are contacted with and fed by all roller pieces 202, the number of which is four or five.

The paper feed tray 203 oscillates around a fulcrum pin 209 provided on the rear edge side of the paper feed tray 203. The roller shaft 201 is pivotally supported by end portions of the supporting arms 211 which oscillate around the fulcrum shaft 210 arranged on the sheet feed side of the paper feed tray 203. At a base end portion of the supporting arm 211, there is integrally provided a sensor lever 212 which extends downward. There is provided a photoelectric sensor 213 for detecting an end of the sensor lever 212.

When the paper feed tray 203 on which sheets of paper are stacked is rotated around the fulcrum pin 209 so that the paper feed tray 203 can be raised, the roller pieces 202 are contacted with the upper surface of the sheet of paper and pushed upward. When the roller pieces 202 are pushed upward, the supporting shafts 211 are oscillated counter-clockwise. In accordance with this oscillation, an end of the sensor lever 212 is detected by the photoelectric sensor 213. When the end of the sensor lever 212 is detected, the rising motion of the paper feed tray 203 is stopped, and the roller shaft 201 is rotated to conduct a paper feed motion.

In the paper feed unit shown in FIG. 11, due to the existence of the recesses 204, the pressing force of each roller piece 202 against the upper surface of the sheet of paper can be made uniform, and further the pressing forces of a plurality of roller pieces 202 against the upper surface of the sheet of paper can be made constant irrespective of the number of sheets of paper stacked on the paper feed tray 203 and also irrespective of a deflection of the sheets of paper into the recesses 204. Therefore, it is possible to stably feed sheets of paper of various widths.

In the above embodiment, on the paper feed tray, there are provided recesses 204 respectively opposed to the roller pieces. However, it should be noted that the same effect can be provided when the paper feed tray is cut out so as to form windows at the positions corresponding to recesses 204.

According to the embodiment explained above, in the paper feed unit provided with a plurality of roller pieces mounted on one roller shaft, even when there are provided a large number of roller pieces at irregular intervals, and even when the roller pieces are arranged unsymmetrically, the pressing forces of the roller pieces can be made uniform irrespective of an error in the parallelism and a difference in the sheet width. As a result, sheets of paper of various widths can be stably fed. Since it is possible to reduce a fluctuation of the pressing forces of the roller pieces which is caused by an error in the parallelism of the roller shaft and the paper feed tray or caused by a deflection of the roller shaft, it is not necessary to provide a high accuracy in the process of assembling or adjusting the paper feed unit. Accordingly, a burden imposed on a worker in the process of assembling can be reduced, and the assembling time can be greatly reduced.

Next, referring to FIGS. 12 to 20, another embodiment of the paper feed unit of the present invention will be explained below in detail.

Figure 12:
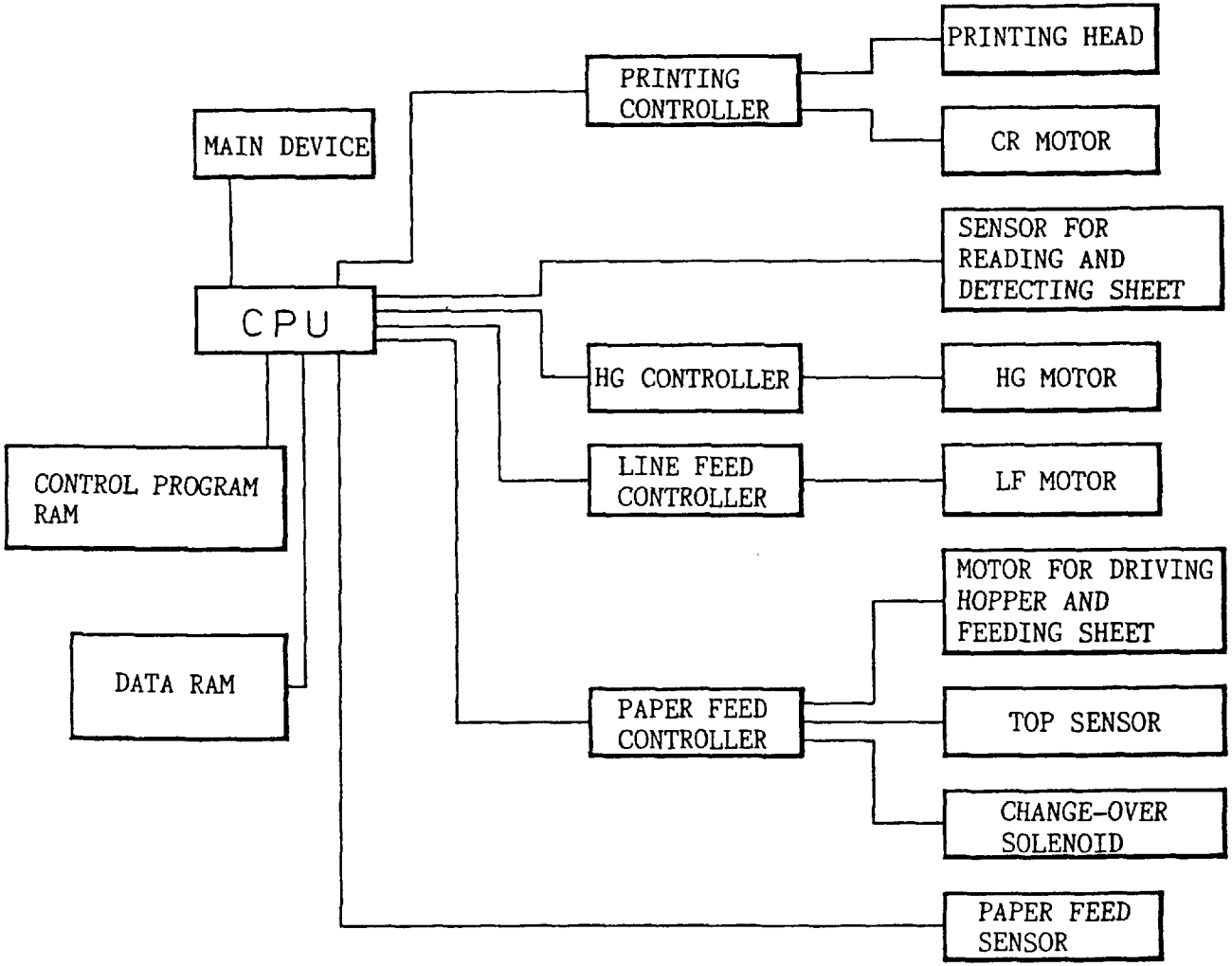
Figure 13:
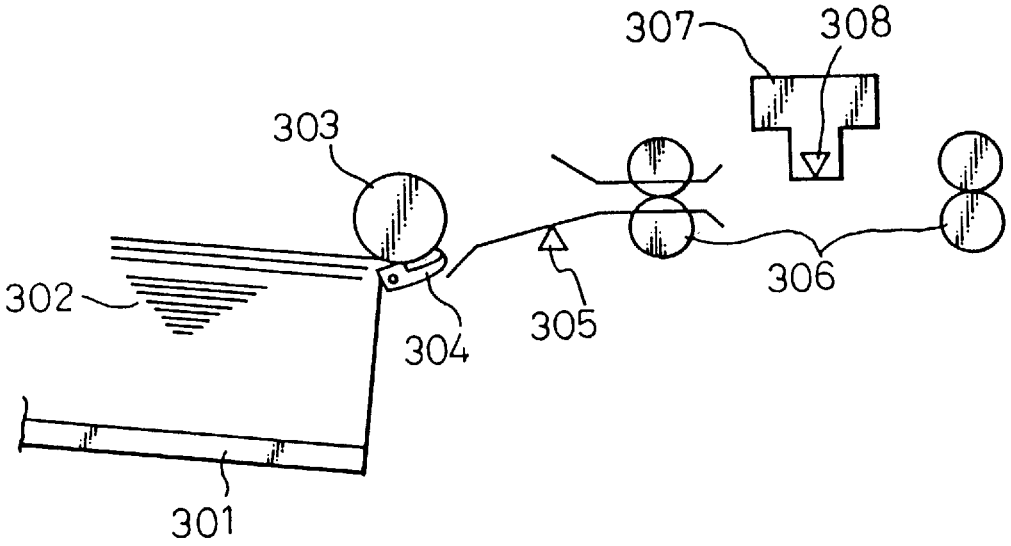

FIG. 12 is a block diagram showing the primary arrangement of a printer in which the paper feed unit of this embodiment is used. FIG. 13 is a side view showing an outline of the printer. In FIG. 12, CPU is a central processing unit to control the motion of the respective parts of this printer.

On the hopper 301 shown in FIG. 13, it is possible to stack a large number of recording sheets of paper 302, and an end portion of the hopper 301 is capable of moving upward and downward. When the hopper 301 is located at the rising position, a paper feed roller (pick roller) 303 provided at an upper portion of the end of the hopper 301 domes into contact with the upper most sheet of paper. There is provided a top sensor for detecting that the uppermost sheet of paper comes to a position of the paper feed roller when the hopper 301 is raised. There is provided a separating pad 304 opposed to the paper feed roller 303, and the second and later sheets of paper are prevented by the separating pad 304 from advancing together with the first sheet of paper. Downstream of the separating pad 304 there is provided a paper feed sensor 305 which detects a leading end of the sheet of paper 302. In the paper feed control section, there are provided a motor used as a hopper motor and at the same time used as a paper feed motor, a change-over solenoid and others.

In the line feed control section, there is provided a motor 306 used for conveying sheets of paper and driving a line feed roller (LF). In the printing control section, there is provided a carriage (CR) motor, which moves a carriage, on which a printing head 307 is mounted, along a platen (not shown) in the transverse direction. The head gap (HG) control section adjusts a gap between the printing head 307 and the platen by the motor for driving a head gap adjusting cam or gear. On the carriage, together with a holding head 307, there is provided a sensor 308 used for reading and detecting sheets of paper.

Figure 14A:
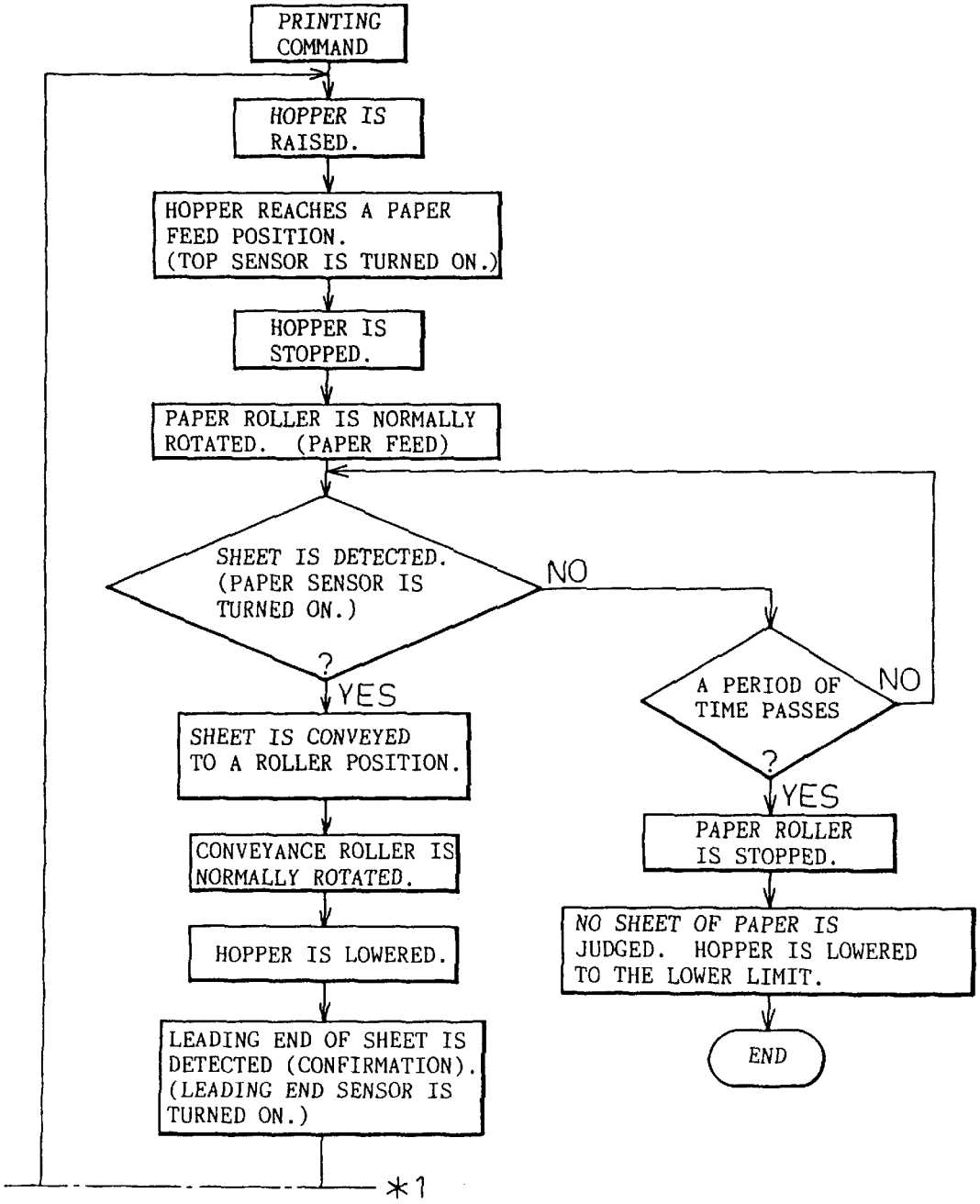
Figure 14B:
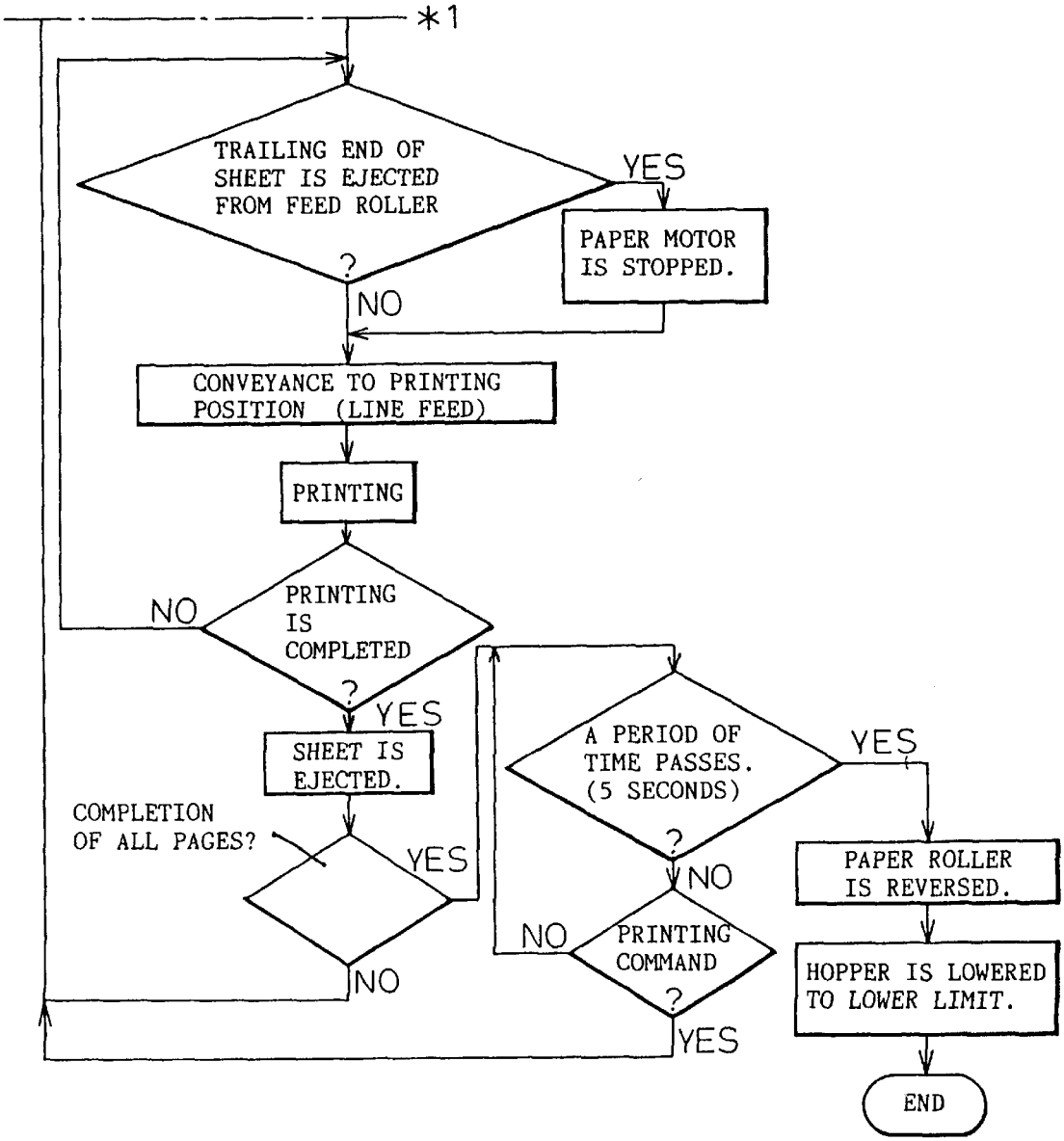

FIGS. 14(*a*) and 14(*b*) are flow charts showing a controlling operation of the paper feed unit of the embodiment of the invention.

First, a printing command is given, and the hopper 301 is raised. When the top sensor detects a rising position of the hopper, the rising motion of the hopper is stopped. At this time, an end portion of the uppermost sheet of paper 302 on the hopper 301 comes into contact with the paper feed roller 303.

Next, the paper feed roller 303 is normally rotated and the paper feed operation starts. The sheet of paper 302 passes through between the paper feed roller 303 and the separating pad 304. When a leading end of the sheet of paper 302 is detected by the paper feed sensor 305, the sheet of paper 302 is successively conveyed to the conveyance roller 306 by the paper feed roller 303. When no sheet of paper is detected by the sensor even if a predetermined period of time has passed after the normal rotation of the paper feed roller 303, it is judged that there is no sheet of paper, and the hopper 301 is lowered to the lower limit position.

After a predetermined period of time has passed from the detection of the end portion of the sheet of paper 302 by the paper feed sensor 305, the sheet of paper 302 reaches the conveyance roller 306. At this time, the conveyance roller 306 is normally rotated. Then the hopper 301 is lowered by a predetermined distance.

Figure 15:
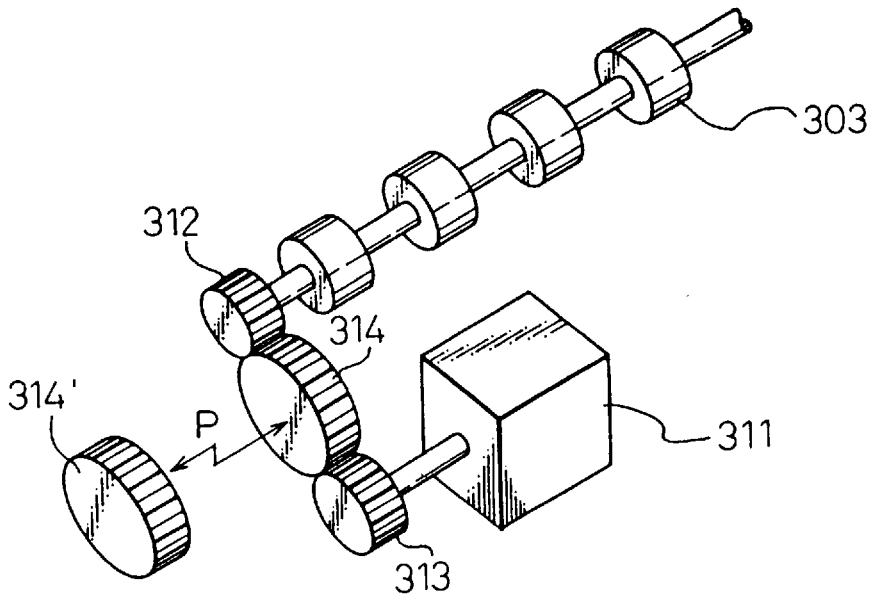

When the leading end portion of the sheet of paper 302 is detected by the paper sensor 308, it is judged whether or not the trailing end portion of the sheet of paper 302 is ejected from the paper feed roller 303. When the trailing end portion of the sheet of paper 302 is ejected from the paper feed roller 303, the paper feed motor (pick motor) is stopped, and the sheet of paper is conveyed by the conveyance roller 306 to a printing position, that is, the line feed motion is conducted, and printing operation is started. When the trailing end portion of the sheet of paper 302 is not ejected from the paper feed roller 303, in the case of the first sheet of paper, the paper feed roller 303 is intermittently driven to detect the sheet length. When the paper feed roller 303 is stopped, for example, as shown in FIG. 15, the paper feed roller 303 is disconnected from the paper feed motor (pick motor) 311, so that a load given to the sheet of paper can be reduced. In this connection, in FIG. 15, reference numeral 303 is a paper feed roller, reference numeral 311 is a paper feed motor, reference numeral 312 is a gear mounted on the paper feed roller shaft, and reference numeral 313 is a gear mounted on the paper feed motor. When an intermediate gear 314, 314' interposed between these gears 312 and 313 is shifted as shown by arrow P in FIG. 15, it is possible that the paper feed roller 303 is connected with or disconnected from the paper feed motor 311.

After the printing operation has been conducted on the sheet of paper concerned, the sheet of paper is ejected. This motion is continuously conducted on a predetermined number of sheets of paper. After the printing operation has been conducted on all sheets of paper, unless the next printing command is given in a predetermined period of time (for example, in five seconds), the paper feed roller 303 is reversed by a predetermined amount of revolutions. In this case, the predetermined amount of revolutions is defined as an amount of revolutions by which the next sheet of paper interposed between the paper feed roller 303 and the separating pad 304 is ejected and returned onto the hopper 301.

Figure 16A:
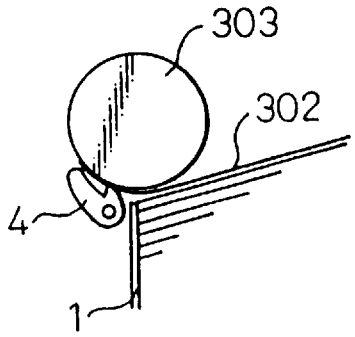
Figure 16B:
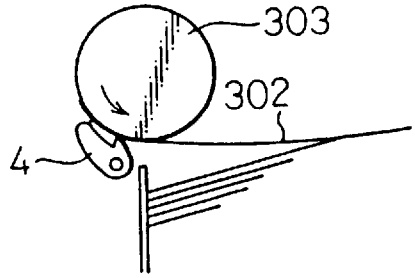
Figure 16C:
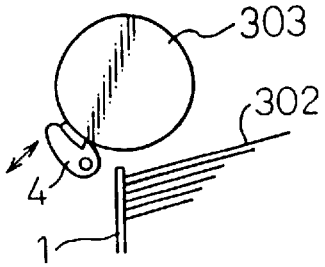

FIGS. 16(*a*) to 16(*c*) are schematic illustrations to explain the operation of the hopper 301 and the paper feed roller 303. FIG. 16(*a*) is a view showing a condition in which the next sheet of paper 302 is interposed between the paper feed roller 303 and the separating pad 304 immediately after the sheets of paper have been fed. FIG. 16(*b*) is a view showing a condition in which the hopper 301 is lowered and the paper feed roller 303 is reversed. FIG. 16(*c*) is a view showing a condition in which the sheet of paper 302 interposed between the paper feed roller 303 and the separating pad 304 is returned onto the hopper 301 by the reverse rotation of the paper feed roller 303. In this connection, an angle of the hopper 301 is preferably determined as follows. As shown in FIG. 16(*a*), at the paper feed position, the uppermost sheet of paper 302 can start sliding on the hopper or the sheet of paper, and as shown in FIG. 16(*b*), when the sheet of paper 302 is returned onto the hopper, it can be stacked on the hopper in good order. That is, it is preferable that the front portion of the hopper 301 is inclined downward.

As described above, in this embodiment, after the first sheet of paper 302 has been conveyed by the paper feed roller 303, the printing operation is completed, and the conveyance of the next sheet of paper 302 starts. Before the start of the next sheet of paper 302, the next sheet of paper 302 is interposed between the paper feed roller 303 and the separating pad 304. However, after the completion of printing the sheet of paper, the paper feed roller 303 is reversed, so that the sheet of paper interposed between the paper feed roller 303 and the separating pad 304 can be returned onto the hopper 301. Accordingly, even when the hopper 301 is removed from the printer, it is possible to remove all the sheets of paper together with the hopper easily.

Figure 17:
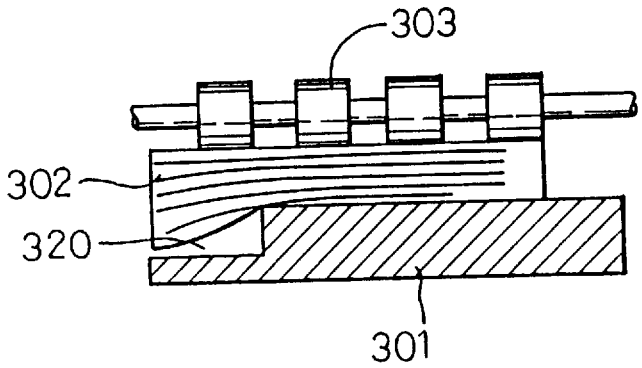
Figure 18:
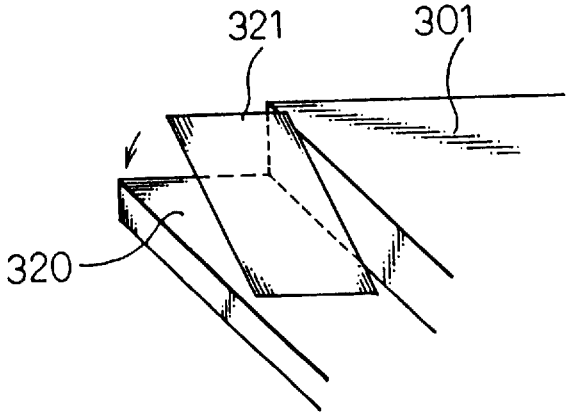
Figure 19:
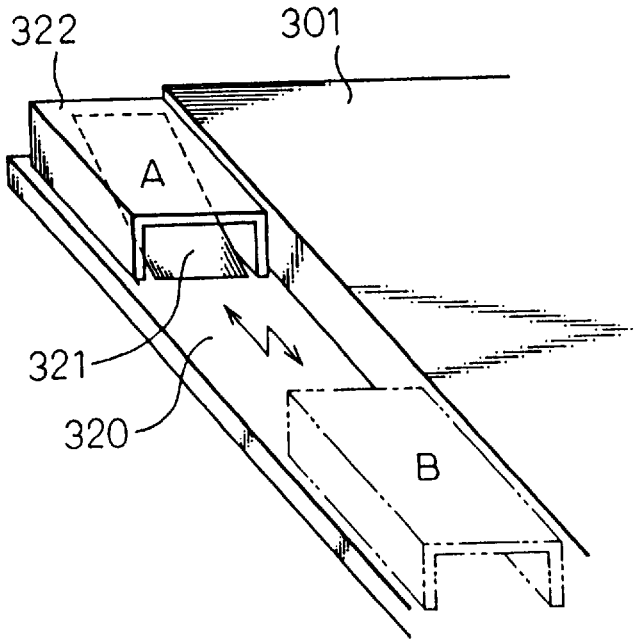
Figure 20:
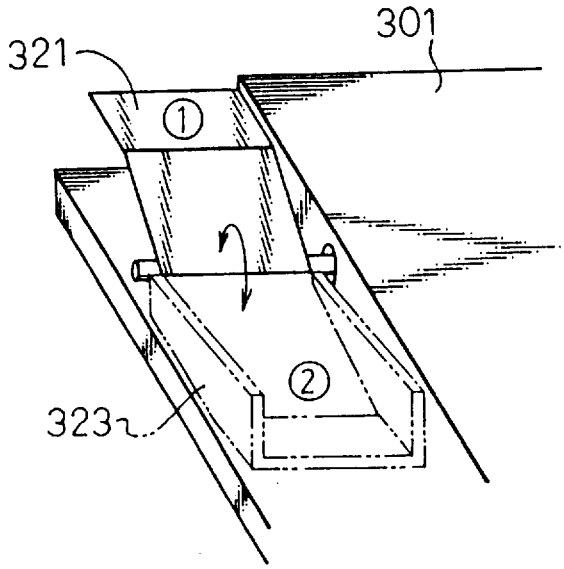

FIG. 17 is a schematic illustration showing the principle of the hopper function. FIGS. 18 to 20 are schematic illustrations of embodiments of the hopper.

In general, when the sheets of paper 302 are deformed and the thickness of the sheets on the right is different from the thickness of the sheets on the left, the paper feed roller 303 partially comes into contact with the sheets of paper 302 stacked on the hopper, which causes a failure of sheet feed and further a skew feed occurs. As shown in FIG. 17, in this embodiment, there are provided recesses 320 on both sides of the front end of the sheet stacking region on the hopper 301. By the recesses 320, the difference in thickness of the sheets of paper 302 can be relieved, and the paper feed roller 303 can be made to uniformly come into contact with the sheets of paper 302. In this way, the sheets of paper can be stably fed.

In the embodiment shown in FIG. 18, there is provided an elastic flap 321 in the recess 320. When a large amount of sheets of paper are stacked on the hopper 301, that is, when the sheets of paper stacked on the hopper 301 are heavy, the flap 321 is given a heavy load, so that the flap 321 is greatly deformed downward and an amount of the recess is increased. When a small amount of sheets of paper are stacked on the hopper 301, that is, when the sheets of paper stacked on the hopper 301 are light, the flap 321 is given a light load, so that the flap 321 is slightly deformed downward and an amount of the recess is decreased. Due to the foregoing arrangement, it is possible to make the paper feed roller 303 come into contact with the sheets of paper 302 at all times irrespective of the number of sheets of paper stacked on the hopper.

In the embodiments shown in FIGS. 19 and 20, there are provided flaps 321 in the recesses 320 provided on both sides of the hopper 301. At the same time, when the sheet thickness is uniform, there is provided a member 322, the section of which is a U-shape as shown in the drawing, at the position A, so that the sheets of paper are prevented from dropping into the recess. When the thickness of sheets of paper on the right is different from the thickness of sheets of paper on the left, this member 322 is slid to the position B as shown in FIG. 19, or alternatively rotated as shown by the two-dotted chain line in FIG. 20 or removed as shown in FIG. 20. In this way, the difference in thickness is relieved. Due to the foregoing arrangement, it is possible to make the paper feed roller 303 come into contact with the sheets of paper 302 irrespective of the number of sheets of paper stacked on the hopper.

As described above, according to this embodiment, after the completion of printing the sheet of paper, the paper feed roller is reversed, so that the sheet of paper interposed between the paper feed roller and the separating pad can be returned onto the hopper 301. Accordingly, even when the hopper 301 is removed from the printer, it is possible to remove all sheets of paper together with the hopper easily. Therefore, the sheets of paper can be fed stably. Even if the thickness of sheets of paper to be fed fluctuates, the sheets of paper can be fed stably.

Figure 21:
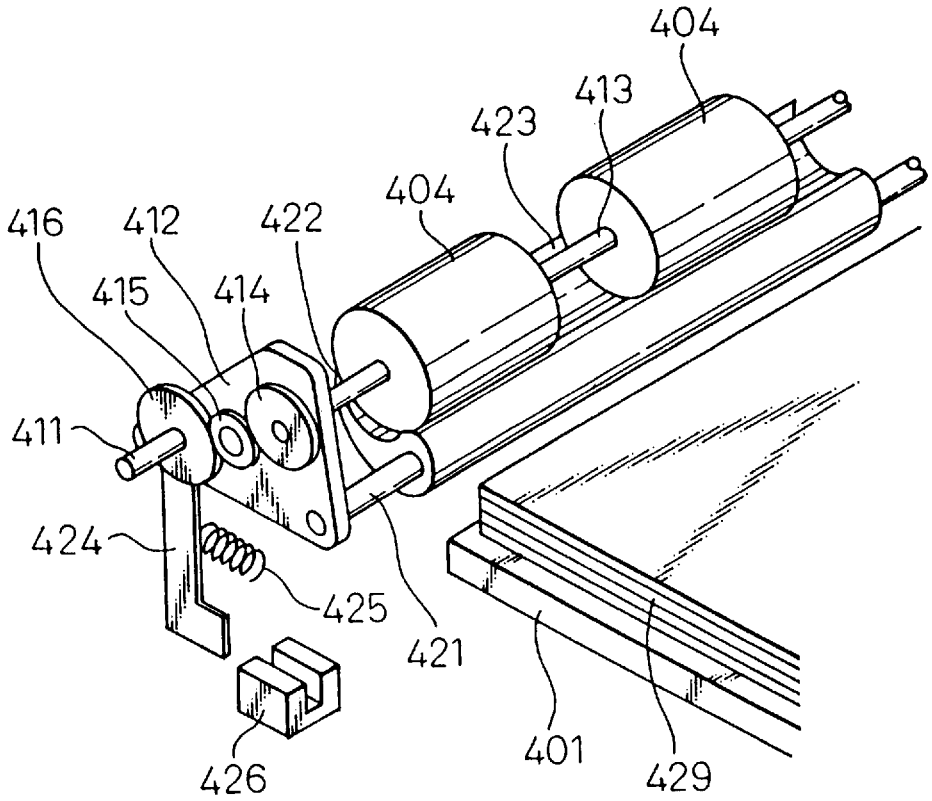

Next, referring to FIGS. 21 to 24, still another embodiment of the automatic paper feed unit of the present invention will be explained below. FIG. 21 is a perspective view showing a model of the primary portion of the automatic paper feed unit, and FIG. 22 is an overall perspective view of the automatic paper feed unit.

Figure 22:
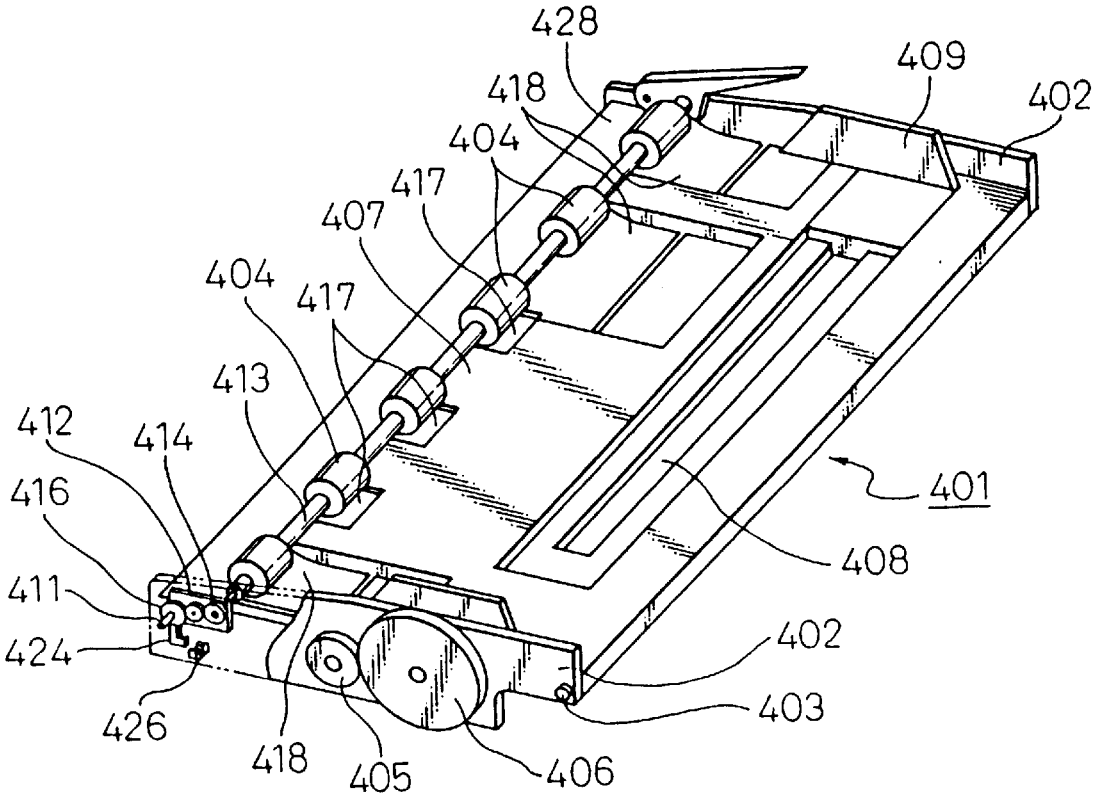

In FIGS. 21 and 22, the paper feed roller 404 is mounted on the roller shaft 413. The roller shaft 413 is pivotally supported by an end of the support lever 412 which is capable of freely oscillating around the fulcrum shaft 411. At an end of the roller shaft 413, there is provided an idle gear 414. This idle gear 414 is meshed with the transmission gear 416 pivotally mounted on the fulcrum shaft 411. There is provided a pad shaft 421 on the support lever 412 in parallel with the roller shaft 413. On the pad shaft 412, there is provided a pad stand 422 pushed clockwise by a spring not shown in the drawing. A separating pad 423, adheres to an end of the pad stand 422. The separating pad 423 comes into elastic contact with the circumferential surface of the paper feed roller 404 by the pushing force of the spring.

Sheets of paper 429 to be fed are stacked on the paper feed tray 401 driven upward and downward by a motor not shown in the drawing. When the paper feed tray 401 is moved upward, an upper surface of the sheet of paper comes into contact with the paper feed roller 404. When the paper feed roller 404 rotates clockwise in the direction of an arrow in the drawing, the sheet of paper is sent out and separated one by one when it passes through between the separating pad 423 and the paper feed roller 404.

The paper feed tray 401 is rotatably attached to the frame 402 via a support pin 403. At the upper edge of the paper feed tray 401, there is provided a paper feed roller 404. The front edge 407 side of the paper feed tray 401 is moved upward and downward by the action of a cam not shown, which comes into contact with a reverse side of the paper feed tray 401, via gears 405, 406 by a motor not shown. On the paper feed tray 401, there is provided a movable side guide 409 which slides along the guide groove 408. In this case, the frame 402 located on the viewer's side in the drawing functions as a stationary side guide.

As can be seen in FIG. 21, the paper feed roller 404 is mounted on the roller shaft 413 attached to the end of the support lever 412 which is capable of rotating around the fulcrum shaft 411. The idle gear 414 is mounted on the end of the roller shaft 413 on the viewer's side. The idle gear 414 is meshed with the transmission gear 416 supported by the fulcrum shaft 411, via an intermediate gear 415 supported by the support lever 412. The transmission gear 416 is rotated clockwise in the drawing by a motor not shown in the drawing, so that the paper feed roller 404 is rotated clockwise in the drawing in the paper feed direction. SIn the apparatus shown in FIG. 22, there are provided six paper feed rollers 404 on the roller shaft 413. At the front edge portion of the paper feed tray corresponding to each paper feed roller, there is provided a recess 417 or a leaf spring 418 used for avoiding a partial contact of the paper feed roller 404 with the sheets of paper 429.

The reference paper feed position of the sheets of paper 429 is determined when the paper feed position sensor 426 detects an end of the sensor lever 424 integrated with the support lever 412. When the paper feed tray 401 is raised, the sheets of paper 429 pushes up the paper feed rollers 404. When the paper feed rollers 404 are pushed up to a predetermined height, the paper feed position sensor 426 detects the end of the sensor lever 424. At this time, the rising motion of the paper feed tray 401 is stopped, and the paper feed roller 404 starts rotating. A pressing force of the paper feed roller 404 against the sheets of paper 429 at this reference paper feed position is determined in accordance with the weight of the paper feed roller 404 and the pad stand 422 and also in accordance with the pushing force of the spring 425. Since the weight of the paper feed roller 404 and the pad stand 422 is higher than the pressing force necessary for feeding a thin sheet of paper without causing double feed, the pressing force of the paper feed roller is adjusted to a predetermined value by a spring 425 which generates a force in a direction so that the support lever 412 can be raised.

In this connection, reference numeral 428 shown in FIG. 22 is a paper guide arranged on the paper feed side of the separating pad 423 in FIG. 21.

Figure 23:
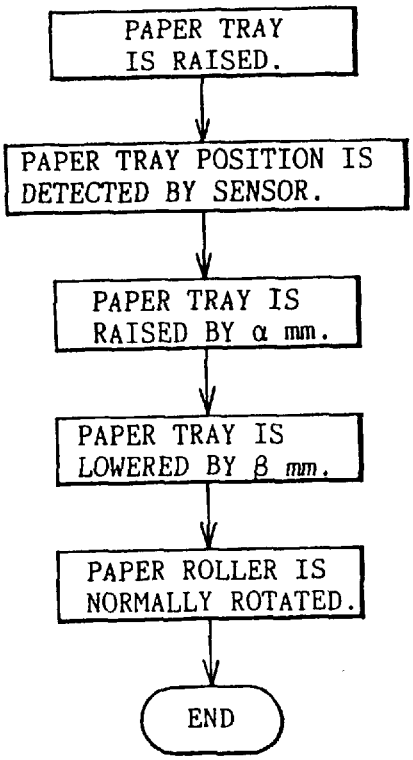

Next, referring to the flow chart shown in FIG. 23, the operation of the embodiment shown in the drawing will be explained below. When a command to feed paper is given, the paper feed tray 401 is raised. Since the paper feed tray 401 is raised, the sheet of paper 429 comes into contact with the paper feed roller 404, and the paper feed roller 404 is raised to a predetermined reference paper feed position. This reference paper feed position can be detected when the paper feed position sensor 426 detects an end of the sensor lever 424. The controller to control an upward and downward motion of the paper feed tray receives a detection signal of the paper feed position sensor 426 and raises the paper feed tray 401 to a predetermined height. Next, the controller gives a command of lowering the paper feed tray 401. At the same time, the controller gives a command of starting the drive motor of the paper feed roller 404. That is, the paper feed motion starts while the paper feed tray is lowering. The amount of lowering of the paper feed tray 401 is previously set at the controller as a value $\beta$. Usually, the value of $\beta$ is determined so that the expression $\beta=\alpha$ can be satisfied, however, the value of $\beta$ may be determined so that the inequality $\beta<\alpha$ can be satisfied. After the paper feed tray 401 has been lowered by the predetermined value $\beta$, the lowering motion of the paper feed tray 401 is stopped, and the rotation of the paper feed roller 404 is continued.

When the sheets of paper 429 stacked on the paper feed tray 401 are thin, the paper feed operation starts at the beginning when the paper feed tray 401 starts to lower. When the sheets of paper 429 stacked on the paper feed tray 401 are thick, the paper feed resistance is high, so that the paper feed operation starts when the lowering motion of the paper feed tray 401 has been completed and the paper feed tray 401 has stopped.

Figure 24:
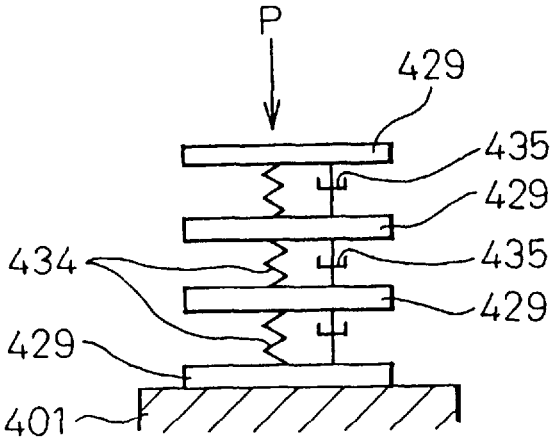

As described above, the sheets of paper 429, which have been stacked, are temporarily pressed by the paper feed roller 404, and while the pressing force is being reduced, the paper feed roller 404 is rotated so as to give a frictional paper feed force to one of the stacked sheets. Due to the above operation, a ratio of occurrence of double feed of the sheets of paper concerned can be greatly reduced. The reason is presumed as follows. Between two sheets of paper, an elastic system, the model of which is composed of a spring 434 and a dash pot 435, is formed as illustrated in FIG. 24. When the paper feed roller 404 is pressed against the stacked sheets of paper, gaps formed among a large number of sheets of paper are crushed. When the pressing force of the paper feed roller 404 against the sheets of paper is released, gaps among the sheets of paper are extended by a resilient restoring force given in a direction perpendicular to the surface of each sheet of paper. An amount of deformation of the sheet of paper in the direction perpendicular to the surface of each sheet of paper is very small and varies by the type of sheet of paper, that is, an amount of deformation of the sheet of paper varies by the structure of sheet of paper and the surface treating condition. However, the overall sheets of paper can be assumed to be an oscillating system with multiple degrees of freedom, the model of which is illustrated in FIG. 24. Accordingly, when a pressing force P is given to and released from the stacked sheets of paper 429, each sheet of paper oscillates with respect to the adjacent sheet of paper in a direction perpendicular to the surface of the sheets of paper. As a result, at one moment, the gap between sheets of paper which are oscillating becomes larger than the gap of sheets of paper in a stationary condition.

When a sheet of paper is fed out, a resisting force is given to it by the action of statistic friction which acts between sheets of paper. Further, this resisting force given by the action of statistic friction can be a cause of double feed. Once a slippage occurs between sheets of paper, the frictional force between them is sharply reduced, because a dynamic friction acts on the sheets of paper. Therefore, it is possible to feed sheets of paper by a low intensity of paper feed force without causing a double feed. When the stacked sheets of paper oscillate as described above, a coefficient of static friction between sheets of paper is temporarily lowered because a gap between sheets of paper adjacent to each other is increased. At this time, a slippage occurs between the sheets of paper, that is, one sheet of paper is fed. It is presumed that the occurrence of double feed can be prevented in this way.

The above oscillation of sheets of paper occurs not only when the pressing force P is instantaneously released from the sheets of paper but also when the pressing force P is reduced at a speed higher than a predetermined speed. When the paper feed tray 401 is lowered substantially at the same speed as the rising speed of the paper feed tray 401, which is an operation conducted even in a conventional paper feed unit, a ratio of occurrence of double feed can be greatly reduced. The above oscillation of the sheets of paper stacked on the paper feed tray occurs when the paper feed tray on which the sheets of paper are stacked is changed over from rising to lowering.

According to the method of the present invention, due the action described above, it is possible to prevent the occurrence of double feed of thin sheets of paper. Accordingly, even if a pressing force of the paper feed roller 404 against sheets of paper 401,is increased by a paper feed roller drive mechanism when a drive force of the paper feed roller 404 is increased, there is no possibility of occurrence of double feed. When such a paper feed roller drive mechanism is used, concerning thick sheets of paper, the paper feed resistance of which is high, the paper feed roller 404 is strongly pressed against the sheets of paper by an increase in the drive force of the paper feed roller 404. Therefore, a high intensity paper feed force can be given to the sheets of paper. As a result, a failure in feeding thick sheets of paper can be prevented.

In the apparatus of the present invention having the as above arrangement, thin sheets of paper are fed at an early stage in which the pressing force of the paper feed roller 404 against the stacked sheets of paper starts to be reduced, and thick sheets of paper are fed when the pressing force of the paper feed roller 404 is increased by the action of the drive system of the paper feed roller 404 after the completion of oscillation of sheets of paper caused by a release of the pressing force.

According to the method of the embodiment of the present invention explained above, the occurrence of double feed can be effectively prevented when the stacked sheets of paper are automatically fed. In the automatic paper feed unit of the present invention in which double feed is prevented by the above method when thin sheets of paper are fed, it is not necessary to adjust the pressing force. Therefore, the manufacturing cost of the apparatus can be reduced. Further, it is possible to reduce a space provided in an upper portion of the paper feed roller in which the paper feed roller is accommodated when it is raised. Accordingly, the installation space of the paper feed unit can be reduced. Furthermore, it is not necessary to conduct such an operation that the paper feed tray is raised again after the detection of a sheet of paper which has been fed out. Therefore, the throughput of sheets of paper can be enhanced. The number of springs to adjust the pressing force of the paper feed roller is only one. Accordingly, it does not take much labor when the apparatus is assembled.

Next, referring to FIGS. 25 to 31, an adjusting device for adjusting a head gap between the platen and the printing head of the printer will be explained below.

Figure 25:
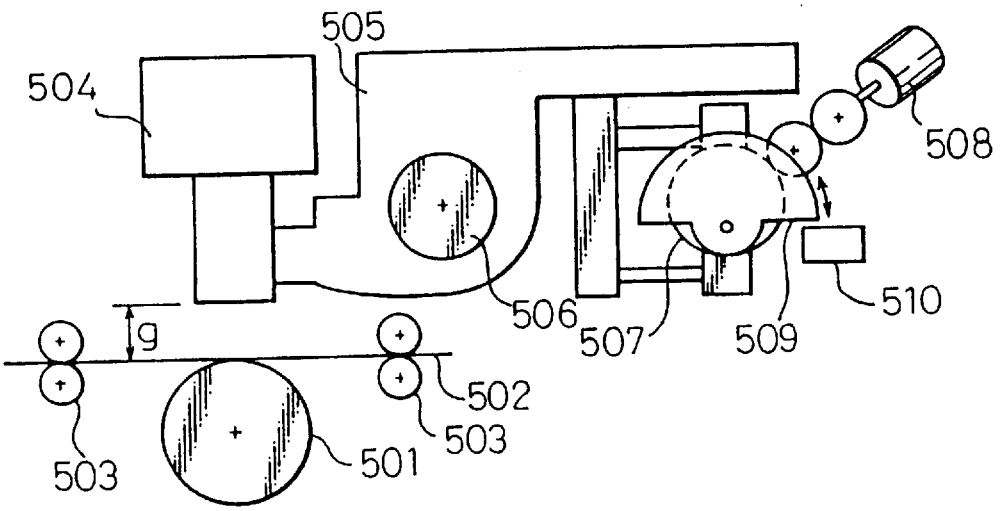
Fig. 25 (PRIOR ART)
FIGS. 25 to 31 are views for explaining a gap adjusting device for adjusting a gap between the platen and the printing head of a printer.

FIG. 25 is a side view showing an outline of the head gap adjusting device of a conventional printer. In FIG. 25, reference numeral 501 is a platen, reference numeral 502 is a recording medium, reference numeral 503 is a conveyance roller for conveying the recording medium, reference numeral 504 is a printing head, reference numeral 505 is a carriage on which the printing head is mounted, reference numeral 506 is a stationary guide shaft for guiding the carriage, reference numeral 507 is an eccentric shaft, reference numeral 508 is a pulse motor for driving the eccentric shaft, reference numeral 509 is a sensor shield plate, and reference numeral 510 is a cam sensor.

There is formed a head gap "g" between the platen 501 arranged at a fixed position and the printing head 504. The head gap "g" can be controlled as follows. When the pulse motor 508 is driven, the eccentric shaft 507 is rotated. Due to the rotation of the eccentric shaft 507, the carriage 505 on which the printing head 504 is mounted is rotated around the stationary guide shaft 506, so that the printing head 504 approaches to or separates from the platen 501. In this way, the head gap "g" can be controlled.

Figure 26:
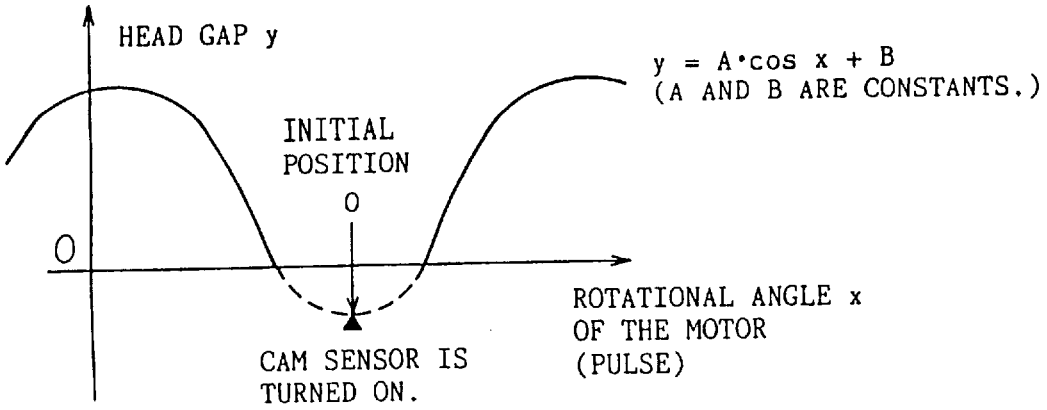

In the conventional automatic adjustment of the head gap described above, a change in the head gap with respect to a rotational angle of the pulse motor for driving the eccentric shaft can be expressed by a sine curve as shown in FIG. 26. When the head gap is adjusted, it is necessary to recognize an initial position (shown in FIG. 26) of the eccentric shaft (cam). Conventionally, as shown in FIG. 25, the initial position of the cam is detected when a position of the eccentric shaft 507 is directly detected by a cam sensor 510 as shown in FIG. 25.

According to the above conventional method in which the initial cam position is detected when the eccentric shaft 507 position is directly detected by the cam sensor 510, it is necessary to provide a relatively expensive cam sensor 510. Also, it is necessary to control a relative positional relation between the eccentric shaft 507 and the cam sensor 510. This control is complicated, and accuracy to detect the initial position is greatly affected by a result of the control.

In the conventional automatic head gap control device in which the eccentric shaft is used, an appropriate gap is determined in the printing process as follows. The printing head or a reference surface for detecting sheet thickness is temporarily pressed against the sheets of paper, and then the gap sensor detects the gap. Then the printing head is returned from the sheet surface by a predetermined amount of pulses which have been previously stored. In this way, an appropriate gap can be set (shown in FIG. 30).

Figure 30:
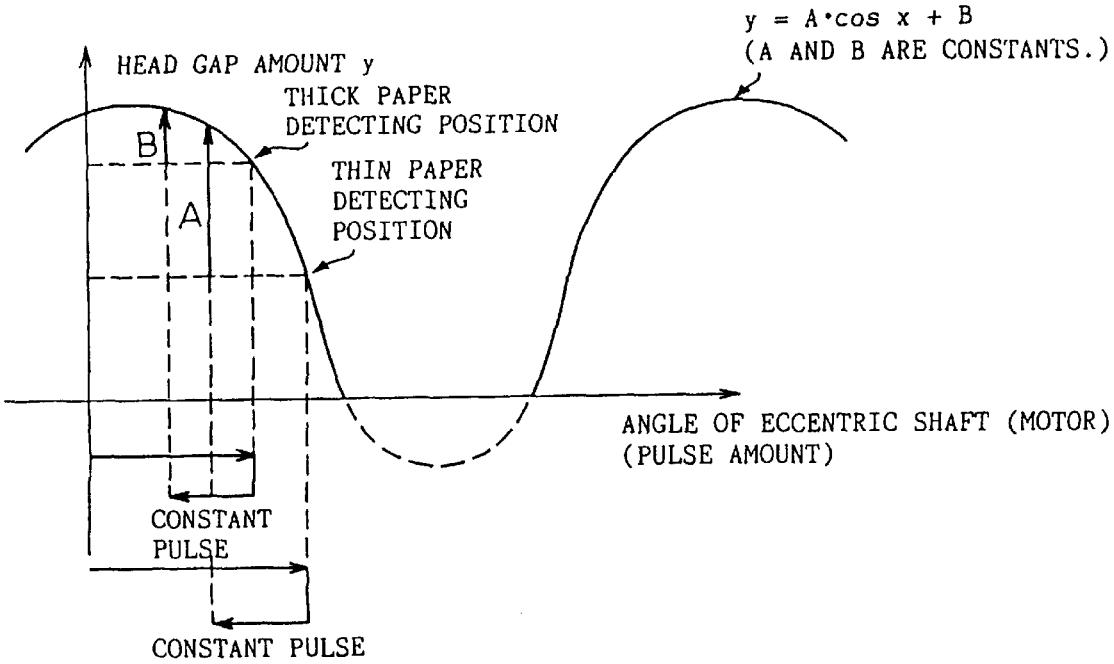

The above gap control method is advantageous in that an amount of gap can be easily adjusted by using a simple, inexpensive eccentric shaft. However, the following disadvantages may be encountered in the above gap control method. As shown in FIG. 30, an amount of return of the head gap with respect to a predetermined pulse of the pulse motor to rotate the eccentric shaft is different between a detection of thin sheets of paper and a detection of thick sheets of paper. Depending upon a thickness of sheets of paper, it is impossible to obtain an appropriate gap. That is, in FIG. 30, for example, in the detection of thin sheets of paper, an amount of return A in the case of returning the head by a predetermined amount of pulse is large, and in the detection of thick sheets of paper, an amount of return B in the case of returning the head by a predetermined amount of pulse is small.

Figure 27:
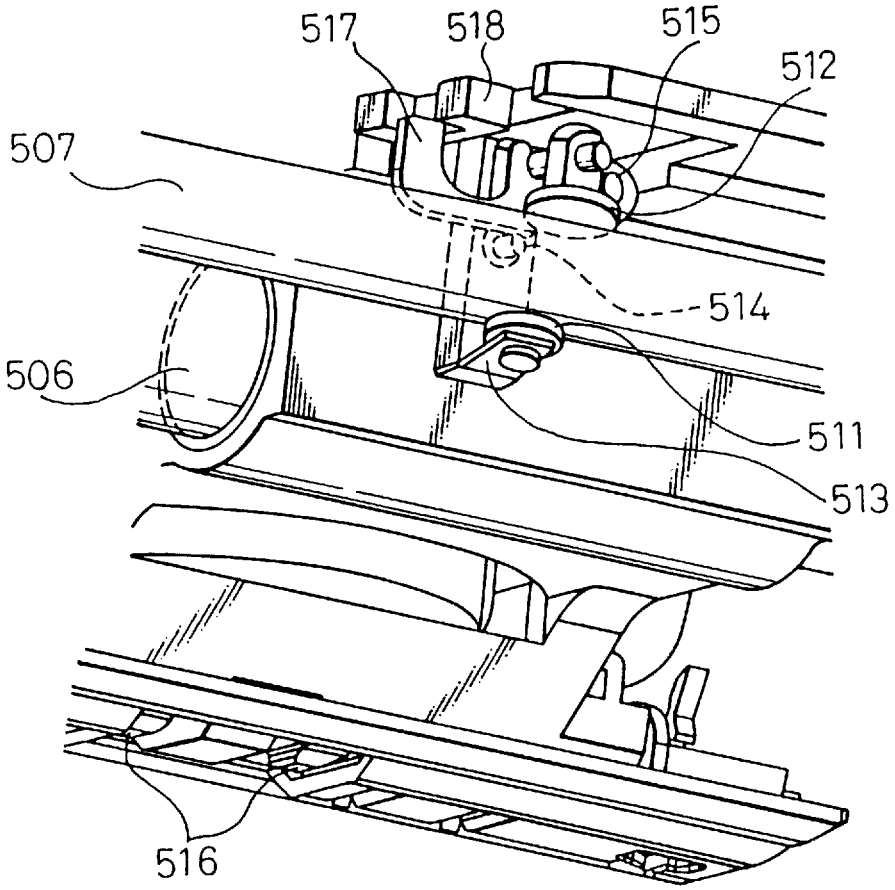

FIG. 27 is a perspective view showing a primary portion of the head gap adjusting mechanism of the printer of the present invention. In FIG. 27, reference numeral 506 is a stationary guide shaft, reference numeral 507 is an eccentric shaft, the section of which is circular, reference numerals 511, 512 are bearing plates which respectively come into contact with an upper and a lower portion of the eccentric shaft, reference numeral 513 is a leaf spring, reference numeral 514 is a support pin of the sensor shield plate, reference numeral 515 is a rotational fulcrum pin of the sensor shielding plate, reference numeral 516 is a reference surface of the carrier 505, reference numeral 517 is a sensor shield plate, and reference numeral 518 is a gap sensor.

The leaf spring 513 presses the bearing plate 511 against the eccentric shaft 507. Therefore, play of the eccentric shaft 507 between the bearing plates 511 and 512 can be absorbed.

Figure 29:
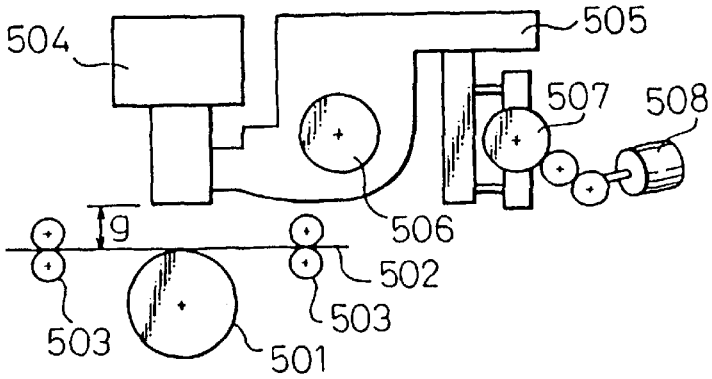

In FIGS. 25 and 29, in the detection of the head gap "g" (shown in FIG. 25) between the platen 501 arranged at a fixed position and the printing head 504, first, the eccentric shaft 507 is rotated, and the reference surface 516 of the carrier 505 is pressed against a sheet of paper 502 on the platen 501. When the eccentric shaft 507 is further rotated, in FIG. 27, the upper bearing plate 512 is pushed upward, and the sensor shielding plate 517 separates from the pin 514 and starts rotating around the fulcrum pin 515. When the gap sensor 518 detects the sensor shielding plate 517, it is judged that the reference surface 516 of the carrier 505 has come into contact with the sheet of paper 502. After the detection conducted by the gap sensor 518, the eccentric shaft 507 is reversed, so that the reference surface 516, that is, the printing head 504 is returned from the sheet of paper 502 by a predetermined amount.

Figure 28:
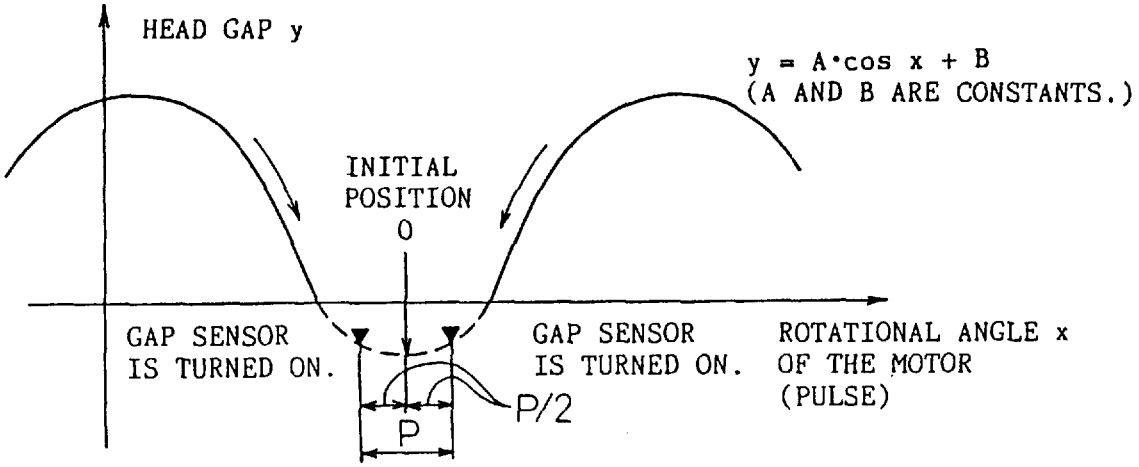

In the present invention, the cam sensor 510 shown in FIG. 25 is not used, but the method shown in FIG. 28 is used for setting an initial position of the head gap. Specifically, the initial position of the head gap is set as follows. By the gap sensor 518 used for the automatic head gap mechanism, a rotational angle $X_1$ of the motor is found when the gap sensor 518 detects a gap in the case where the pulse motor 508 is rotated in one direction, and a rotational angle $X_2$ of the motor is found when the gap sensor 518 detects a gap in the case where the pulse motor 508 is rotated in the reverse direction. An intermediate point $(X_1-X_2)/2$ of these rotational angles is determined to be an initial position.

As described above, according to the present invention, even when the cam sensor 510 is not used, the initial position can be easily determined. Since the cam sensor 510 is unnecessary, the cost of the apparatus can be reduced. Further, it is unnecessary to control a relative positional relation between the eccentric shaft 507 and the cam sensor 510. Therefore, the cost can be more reduced.

FIG. 29 is a side view showing an outline of the printer having an automatic head gap adjusting device. In the same manner as that shown in FIG. 25, reference numeral 501 is a platen, reference numeral 502 is a recording medium, reference numeral 503 is a conveyance roller for conveying the recording medium, reference numeral 504 is a printing head, reference numeral 505 is a carriage on which the printing head is mounted, reference numeral 506 is a stationary guide shaft for guiding the carriage, reference numeral 507 is an eccentric shaft, and reference numeral 508 is a pulse motor for driving the eccentric shaft.

Figure 31:
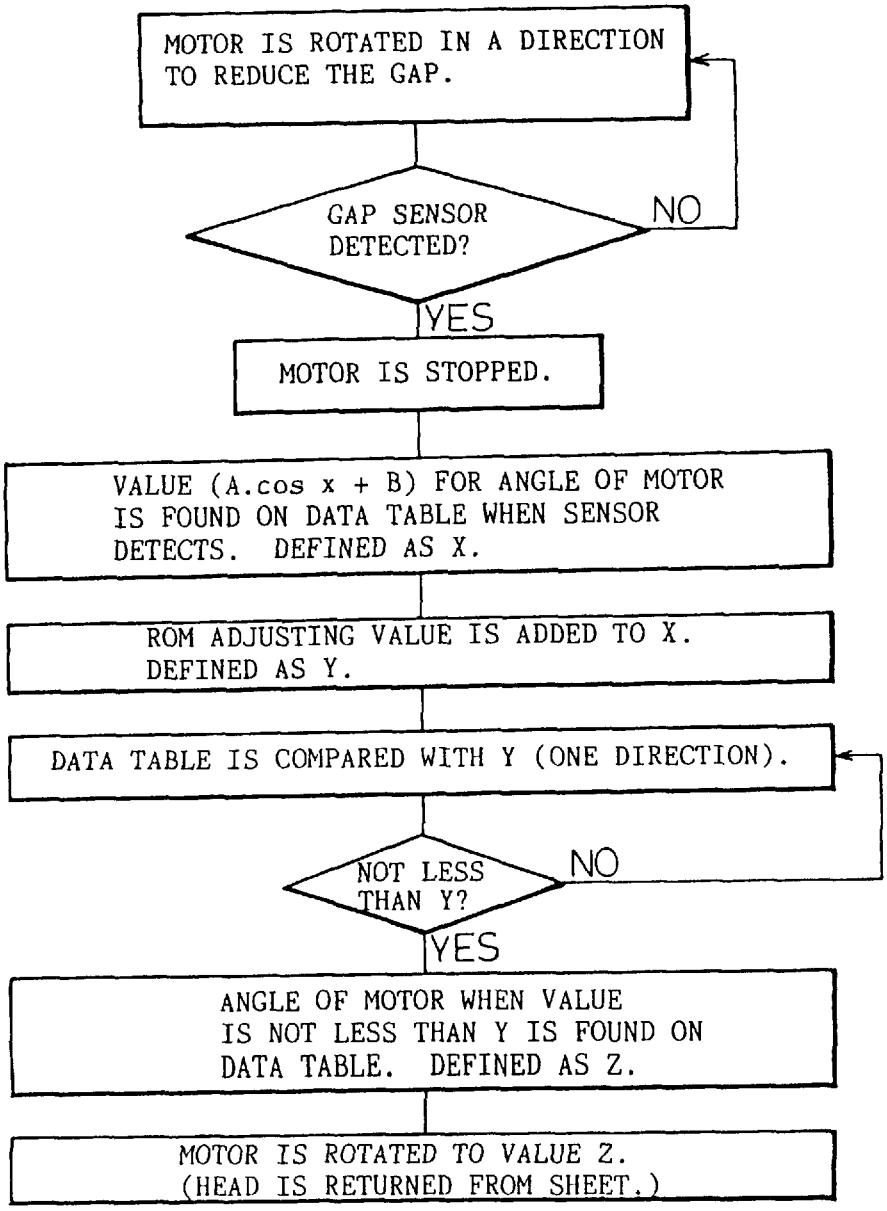

Unlike a conventional apparatus in which a predetermined amount of pulses are stored for returning the printing head after the reference surface of the carriage has been temporarily pressed against sheets of paper so as to detect the gap, in the automatic head gap controlling mechanism described above, the gap is adjusted according to the following procedure shown on Table 1 and FIG. 31.

(1) First, in the process of manufacturing a printer, when the reference surface of a carriage is pressed against a platen under the condition that no sheet of paper is fed between the platen and the printing head, a gap between the platen and the printing head is detected. At this time, a rotational angle of the motor or an amount of pulses (for example, 170) are stored, and also a value (−0.10) representing a position of the printing head is stored. At the same time, a table value (A·cos x+B) shown on Table 1 representing a printing head position corresponding to each rotational angle of the motor is stored in ROM.

TABLE 1

| Rotational Angle of Motor (Amount of Pulses) | Computed Value of A.cos x + B (Table Value) | |
|---|---|---|
| 0 | 3.00 | |
| 1 | 2.99 | |
| 2 | 2.98 | |
| 3 | 2.97 | (6) |
| . | . | |
| . | . | |
| . | . | |
| 29 | 2.59 | (5) |

TABLE 1-continued

| Rotational Angle of Motor (Amount of Pulses) | Computed Value of A.cos x + B (Table Value) | |
|---|---|---|
| 30 | 2.57 | (4) |
| 31 | 2.55 | |
| . | . | |
| . | . | |
| . | . | |
| 162 | 0.30 | (2) |
| . | . | |
| . | . | |
| . | . | |
| 168 | 0.00 | |
| 169 | −0.05 | |
| 170 | 0.10 | (1) |
| | | (3) |

Remarks:
(6) The motor rotated to this point.
(5) The point at which the value becomes higher than 2.97 is found by making a comparison.
(4) The gap sensor detecting position in the case of thick sheets of paper 2.57 + 0.40 = 2.97
(2) The gap adjusting position in the case of no sheet of paper (in the manufacturing process)
(1) The gap sensor detecting position in the adjustment in the case of no sheet of paper in the manufacturing process
(3) 0.30 − (−0.10) = 0.40
The value of 0.40 is stored in ROM.

(2) Next, the printing head is returned from a position, at which the printing head comes into contact with the platen, by a predetermined amount of gap. At this time, for example, an amount of pulses are 162, and a value representing the printing head position is 0.30.

(3) Next, the value 0.30−(−0.10)=0.40, which is a difference between this table value (A·cos x+B) and the initial table value, is stored in ROM as an adjusting value.

(4) When a recording medium is actually fed and the gap is automatically adjusted, the pulse motor is rotated in a direction so that the gap of the printing head can be reduced. After the gap has been detected by the gap sensor, and a table value corresponding to the rotational angle of the motor (for example, 30) in the detection conducted by the sensor is read out from the data table shown on Table 1. This value is defined as x (2.57). An adjusting value. (0.40) stored in ROM is added to this value x. The thus adjusted value is defined as Y (2.57+0.40=2.97).

(5) The data table is compared with Y, and a table value higher than Y is found. The rotational angle of the motor at this time is read out from the data table. This value is defined as Z (3).

(6) Then the motor is rotated by an amount of Z in a direction so that the printing head can be separated from the recording medium. In this way, an appropriate amount of the gap can be provided.

According to the above head gap adjusting method, the number of pulses for returning the head is changed in accordance with an angle of the eccentric shaft in the case of detection of the gap conducted by the gap sensor.

Accordingly, irrespective of the thickness of a recording medium, it is possible to obtain a constant head gap in the overall rotational region of the eccentric shaft.

Due to the foregoing, as compared with the conventional apparatus, it possible to extend a range of the recording medium thickness to be allowed to the same eccentric shaft. It is not necessary to increase an amount of eccentricity of the eccentric shaft with respect to the thickness range of the recording medium to be allowed. As a result, the motor size can be reduced.

Figure 32:
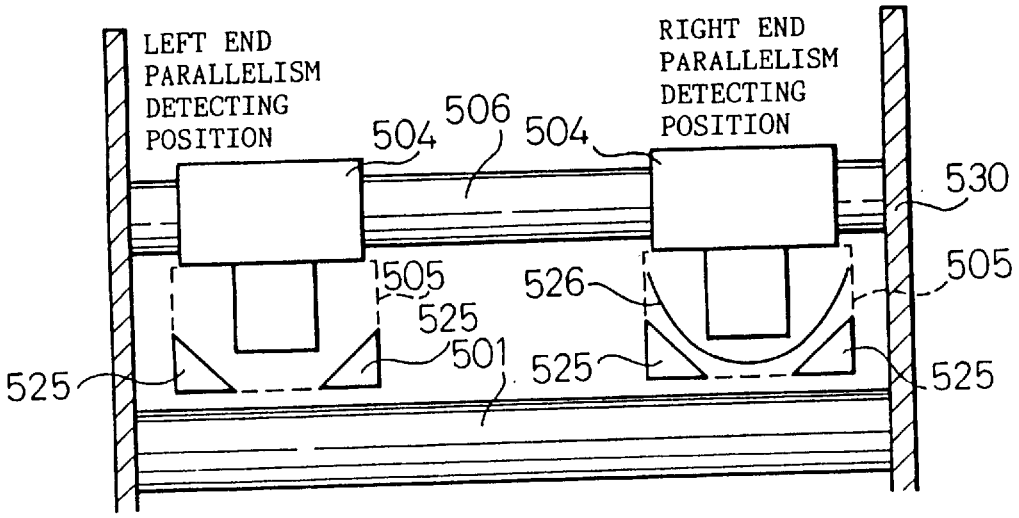
FIG. 32 is a view showing a model of the method by which the parallelism of the gap of the printing head of the printer is adjusted.

FIG. 32 is a schematic illustration showing a printing head parallelism adjusting device of the printer relating to the above embodiment. The printing head 504 is mounted on the carrier 505. On both sides of the printing head 504, two members 525 are attached to the carrier 505 at an interval in the direction of advancement of the carrier 505, that is, in the direction of a guide shaft 506. These members 525 are respectively provided with reference surfaces. These members 525 are capable of moving by the action of a pulse motor (not shown) so that the reference surfaces can be contacted with and withdrawn from the platen 501.

That is, these members 525 are moved as follows. When the electric power is turned on so as to drive the printer, or before sheets of paper are fed to the printer, the carrier 505 is moved to the left end of the guide shaft 506, and the pulse motor is driven. Due to the foregoing, each member 525 is moved from a predetermined position to the platen 501 side. When the reference surface comes into contact with the platen 501, the table value Y1 of the two members 525 on the reference surface is stored. After that, these members 525 are withdrawn to the predetermined positions.

Next, the carrier 505 is moved to the right end of the guide shaft 506, and the pulse motor (not shown) is driven in the same manner. When each member is moved from the predetermined position to the platen 501 side and the reference surface is contacted with the platen 501, the table value Y2 of the two members 525 on the reference surface is stored. After that, these members 525 are withdrawn to the predetermined positions.

A difference between the table values Y1−Y2=Y3 is stored in ROM. When a sheet of paper is fed, it is made to come into contact with the reference surface, and the table value Y4 at this time is stored. By the above comparison method, it is found how many pulses are required to move the printing head from Y4 by an amount of Y3. In this case, an amount of pulses are different in accordance with the sheet thickness. According to the number of pulses that has been found in this way, the printing head 504 is adjusted in the upward and downward direction with respect to the carrier 505. Therefore, it is possible to maintain a gap between the printing head 504 and the platen 501 constant at all times.

According to the present invention, it is not necessary to provide a strong frame made of a metallic sheet for holding the parallelism of the printing head 504 with the platen 501. It is possible to use an inexpensive frame 530 made of resin instead of the strong frame made of a metallic sheet. In the process of manufacturing a printer, it is not necessary to adjust a parallelism of the printing head 504. In this connection, reference numeral 526 shown in FIG. 32 is an ink ribbon.

Next, referring to FIGS. 33 to 42, a printer having a sound insulating mechanism will be explained below. In this connection, an impact printer having a sound insulating mechanism, in which a noise source such as an impact head exists, and where the printer includes a paper entrance from which a recording medium such as a sheet of recording paper or a film sheet is sent and ejected will be explained here.

Figure 33:
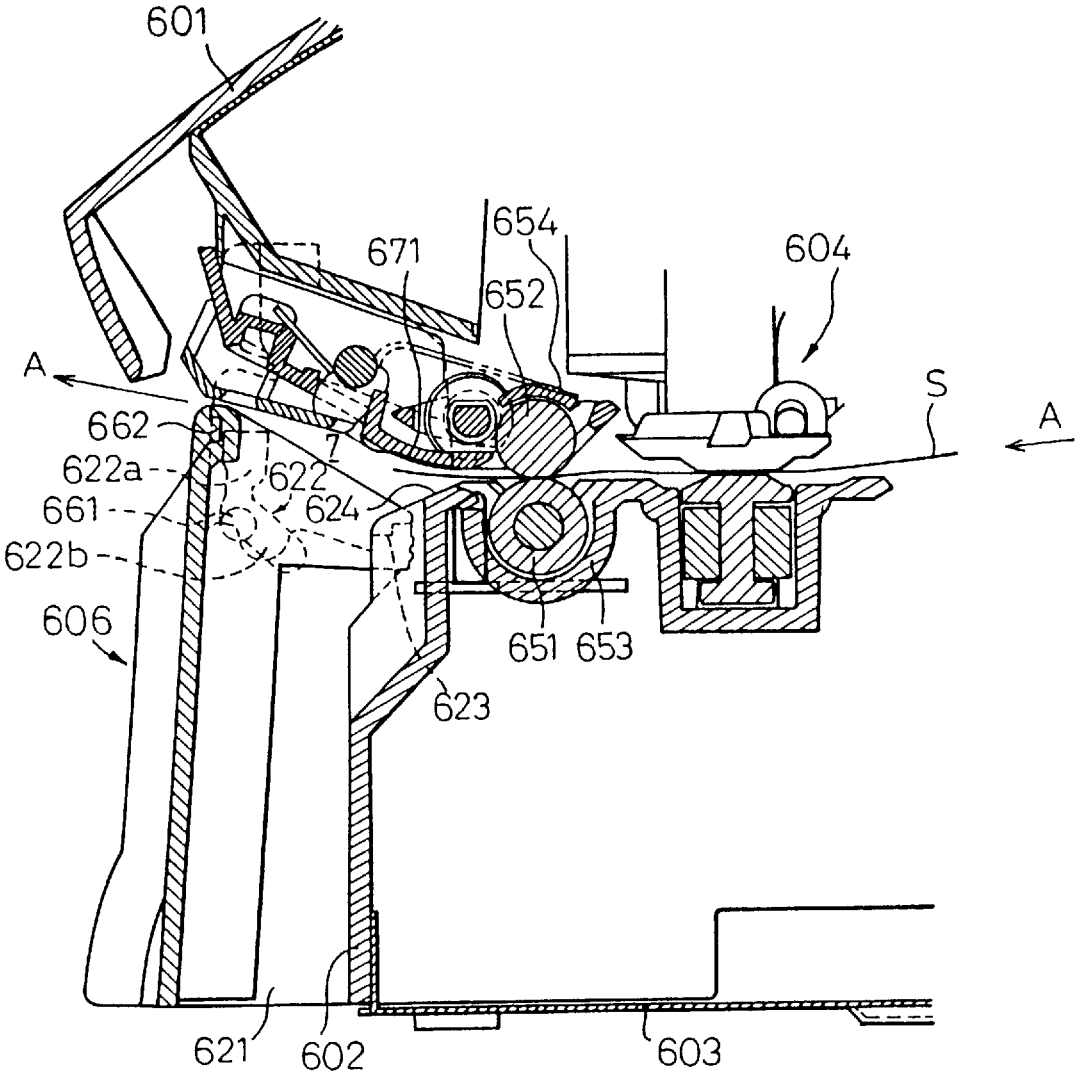
Figure 34:
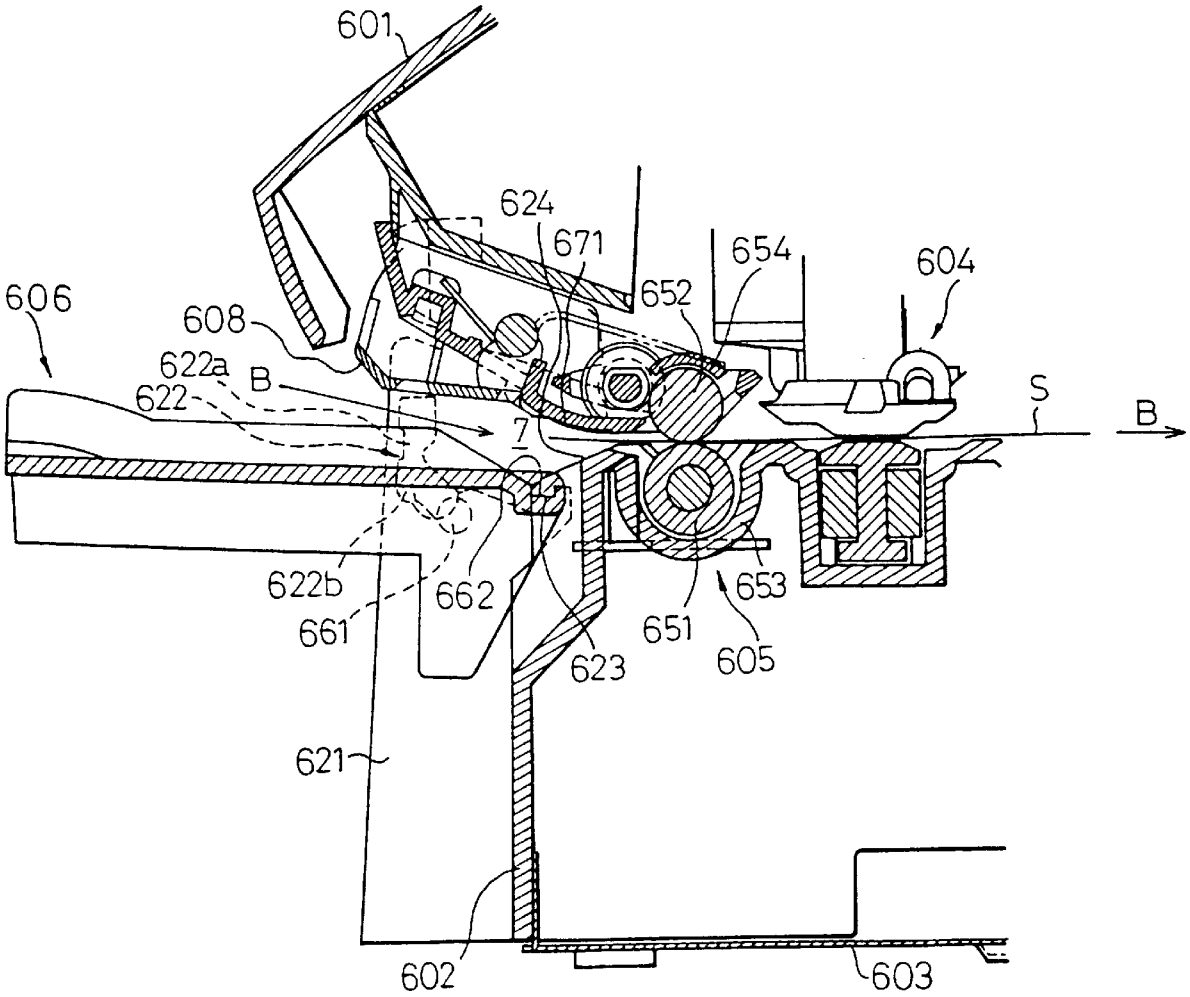
Figure 35A:
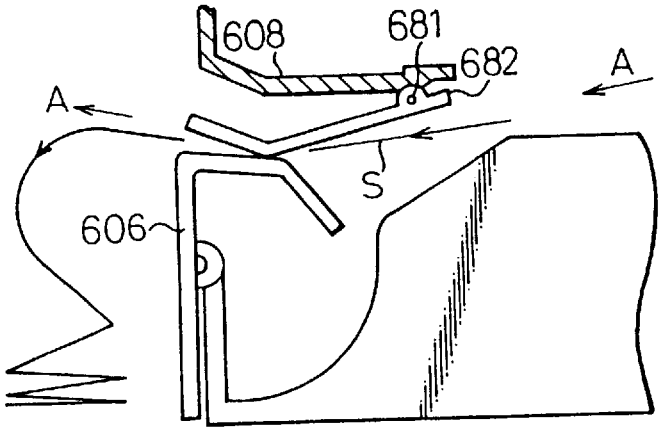
Figure 35B:
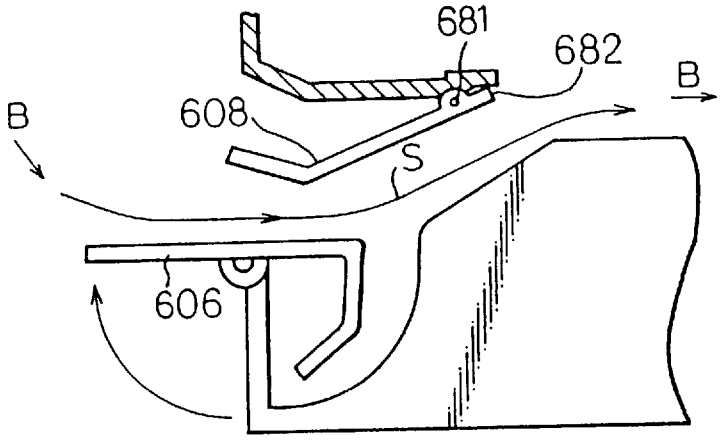

FIGS. 33 and 34 are cross-sectional views showing a portion of the impact printer into which a sound insulating mechanism is incorporated. FIGS. 35(*a*) and 35(*b*) are schematic illustrations showing an outline of the sound insulating mechanism including a flap which is incorporated into the printer shown in FIGS. 33 and 34.

In these drawings, reference numeral 601 is an upper casing, reference numeral 602 is a side casing, and reference numeral 603 is a bottom portion. This printer is substantially closed except for a paper entrance 607 described later. In the printer, there is provided an impact head 604 which is a noise source. When a recording medium (sheet of paper S) such as a recording sheet of paper or a film sheet passes through this impact head 604, printing operation is conducted. At this time, noise is generated by the impact operation. Since the structure of the impact head 604 is well known, the detail of the structure is omitted here.

In a sheet passage provided in the printer, there are provided a pair of feed rollers 605. One of the feed rollers 605, that is, a lower roller is a drive roller, and the other roller 652, that is, an upper roller is an idle roller. Reference numeral 653 is a guide groove which covers the drive roller 651, and reference numeral 654 is a sound insulating guide which covers the idle roller 652.

For example, when sheets of continuous-form paper are used as sheets S in this printer, as shown in FIGS. 33 and 35(*a*), the sheets S are conveyed in the direction of arrow A. For example, when sheets of cut-form paper are used as sheets S in this printer, the sheets of paper 605 are conveyed in the direction of arrow B as shown in FIGS. 34 and 35(*b*).

Therefore, when the sheets of continuous-form paper are used, the cover member 606 is locked and fixed so that it can cover the side casing 602, and when the sheets of cut-form paper are used, the cover member 606 is raised to a substantially horizontal condition so that it can function as a paper guide.

In the apparatus body, on the walls 621 on both sides of the side casing 602, there are symmetrically provided substantially L-shaped grooves 622, wherein each groove 622 is composed of a substantially vertical upper groove portion 622*a* and a lower groove portion 622 extending obliquely downward. There is provided a fixing hook 623 immediately below the paper passage of the side casing 602. On the other hand, on both sides of the cover member 606, there are symmetrically provided pins 661 engaging with the grooves 622. At an upper end of the cover member 606, there is provided a hook 662 engaging with the fixing hook 623.

Consequently, when sheets of continuous-form paper are processed, the operation is conducted as follows. An end of the cover member 606 arranged in a substantially horizontal condition as shown in FIG. 34 is raised a little upward in a direction opposite to the direction indicated by arrow B.

Then the pin 661 is moved from a lower end portion of the lower groove portion 622*b* to obliquely upward, so that the hook 662 at the end is disconnected from the fixing hook 623 it corresponding to it. After the hook 662 of the cover member 606 has been completely disconnected from the fixing hook 623, the end of the cover member 606 is pushed downward and moved until it collides with the side casing 602. In this way, the cover member 606 is set in a substantially vertical condition. At this time, the cover member 606 is lightly locked to the side casing 602 by a well known means not shown in the drawing.

On the contrary, when sheets of cut-form paper are used, the operation is conducted as follows. A lower end (front end) of the cover member 606, which is set in a substantially horizontal condition as shown in FIGS. 33 and 35(*a*), is raised upward and the lock is released. Then the cover member 606 is raised upward while the pin 661 is used as a fulcrum. After the cover member 606 has exceeded a horizontal condition, it is lightly pushed downward. Then the pin 661 of the cover member 606 is moved from the upper groove portion 622*a* of the groove 622 to the lower groove portion 622*b*. During this motion, the hook 662 of the cover member 606 is engaged with the fixing hook 623 of the side casing 602 from the lower side, and the pin 661 is moved to a lower end portion of the lower groove portion 622*b*. Therefore, the cover member 606 is locked in a substantially horizontal condition shown in FIGS. 34 and 35(*b*). In this case, the cover member 606 functions as a sheet guide when sheets of cut-form paper are inserted in the direction of arrow B by hand feeding.

The sheet entrance 607 is formed between an upper end portion 624 of the side casing 602 and an upper sheet guide 671. An opening of this sheet entrance 607 is made to be as small as possible, so that the noise generated inside the printer can not leak out from the sheet entrance 607.

When a continuous-form paper is used, the cover member 606 is set in a substantially vertical condition as shown in FIGS. 33 and 35(*a*). At this time, an end portion of the cover member 606 comes into contact with the flap 608 of the apparatus body, so that the flap 608 is lightly pushed upward.

Consequently, when continuous-form paper is used, the operation is conducted as follows. Using feed holes formed on both sides of the continuous-form paper, the sheet S is conveyed in the direction of arrow A in FIG. 33 by the action of a tractor not shown in the drawing. Printing is conducted by the impact head 604, and then the sheet S is conveyed by the feed roller 605 and passes through the sheet entrance 607. After that, the sheet of paper S is ejected outside from a gap formed between the upper end of the cover member 606 and the flap 608.

On the other hand, when sheets of cut-form paper are used, the operation is conducted as follows. As shown in FIGS. 34 and 35(*b*), the sheet of paper S is inserted in the direction of arrow B by hand feeding while the cover member 606 is used as a horizontal sheet guide. The sheet of paper S passes through the sheet entrance 607 and is sent to the feed roller 605 (651, 652). Then printing is conducted by the impact head 604. After that the sheet of paper S is further conveyed in the direction of arrow B and ejected outside the apparatus from an entrance not shown in the drawing.

In this connection, in the embodiment shown in FIGS. 33 and 34, the flap is made of resin integrally with the casing portion. When the cover member 606 is closed into a vertical condition, the flap 608 is lightly pushed upward by the upper end portion of the cover member 606. At this time, the flap 608 is deformed since it is flexible. A pushing force given by the flap 608 is very small. Therefore, the conveyance of the sheet of paper S is not affected by the pushing force given by the flap 608.

In the embodiment shown in FIGS. 35(*a*) and 35(*b*), the flap 608 is connected with thecasing portion via a pivot 681. Therefore, when the cover member 606 is closed, the flap 608 closes an opening of the sheet entrance by its weight (shown in FIG. 35(*a*)). At this time, the flap 608 closely comes into contact with the sheet of paper S. At the same time, the flap 608 follows a change in the thickness of the sheet of paper S, so that the size of the opening can be changed. On the other hand, when the cover member (sheet guide) 606 is opened (shown in FIG. 35(*b*)), a stopper 682 of the flap 608 comes into contact with the casing portion, so that the flap 608 stops at a predetermined position. In this way, the opening of the sheet entrance can be defined when sheets of paper are fed by hand feeding.

According to the present invention, when either sheets of continuous-form paper or sheets of cut-form paper are used, the opening of the sheet entrance is substantially completely closed as described above, and the sound insulating effect can be remarkably enhanced. Since the opening portion of the sheet entrance is completely closed, noise can not be transmitted from the opening portion, and further vibration of sheets can be suppressed. Therefore, it is possible to prevent a generation of noise caused when sheets of paper are vibrated. As a result, the sound insulating effect can be more enhanced.

Figure 36:
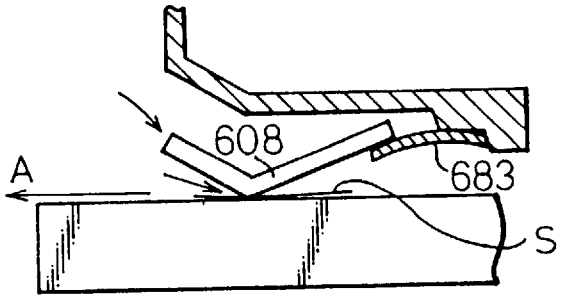
Figure 37:
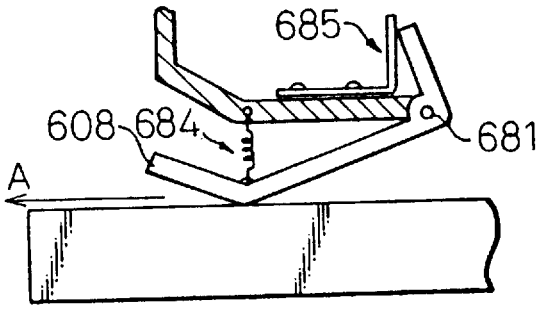
Figure 38:
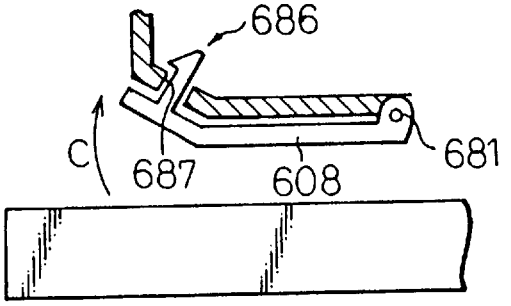

FIGS. 36 to 38 are schematic illustrations respectively showing an embodiment of the sound insulating mechanism including a flap.

In the embodiment shown in FIG. 36, the flap 608 is attached to the apparatus casing via an elastic member 683 made of a polyester sheet. By the action of the elastic member, an intensity of the pressing force given to the sheet of paper S is adjusted. Due to the foregoing, it is possible to prevent an excessively strong force to be given onto the sheet of paper, and the occurrence of sheet-jam can be avoided.

In the embodiment shown in FIG. 37, the flap 608 is connected with the casing portion via a pivot 681, and a pressing force is given to the sheet of paper S by a coil spring 684. In this arrangement, the stopper 682 is in cooperation with the leaf spring 685.

In the embodiment shown in FIG. 38, the flap 608 is connected with the casing portion via the pivot 681, and when the flap 608 is opened upward in the direction of arrow C, a claw portion 686 of the flap 608 is engaged with a hole 687 formed on the casing, so that the flap 608 can be locked in an open condition. According to this embodiment, the following effects can be provided. When thin sheets of paper are used, sheet jam tends to occur. In this case, the flap 608 is kept open, so that the occurrence of jam can be easily prevented even if the sheets of paper are used. In this connection, when the flap 608 is closed, it is sufficient to push down the flap 608. Due to the foregoing, the claw 686 can be easily disengaged from the hole 687, and the sheet opening portion can be closed.

FIGS. 39 to 42 are schematic illustrations respectively showing an embodiment of the sound insulating mechanism of the feed roller portion.

Figure 39:
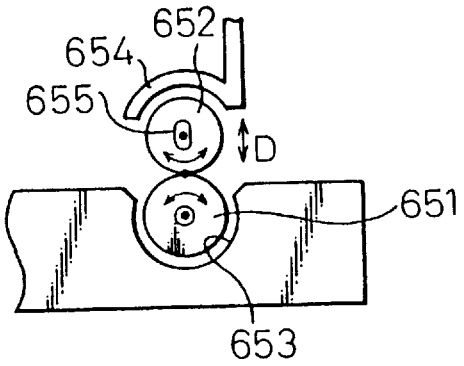

In the embodiment shown in FIG. 39, a shaft of the upper roller 652 is supported in a long hole 655 of the roller support portion of the apparatus body. Due to the above arrangement, the upper roller 652 moves upward and downward by its weight in accordance with the thickness of sheets of paper as shown by arrow D in the drawing. In this way, it is possible to adjust a gap of the sheet passage formed between the upper 652 and the lower roller 651.

Figure 40:
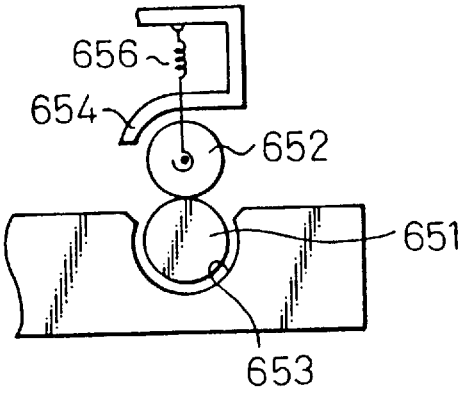

In the embodiment shown in FIG. 40, the upper roller 652 is supported so that it can be moved upward and downward. When this upper roller 652 is pressed against the lower roller 651 by the spring 656, it is possible to adjust a gap between the upper 652 and the lower roller 651.

In this connection, in the embodiments shown in FIGS. 39 and 40, the lower roller 651 is rotatably accommodated in the groove 653 of the sheet passage, and the upper roller 652 is covered with the sound insulating cover 654, so that the transmission of sound can be suppressed.

Figure 41:
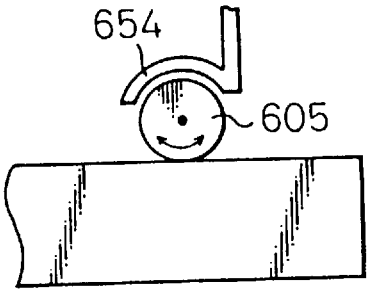
Figure 42:
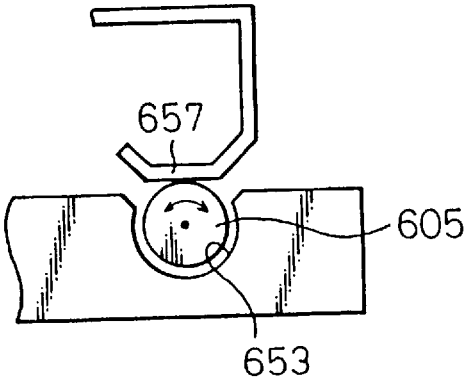

In the embodiment shown in FIG. 41, one rotatable roller 605 is provided in the apparatus. This rotatable roller 605 is covered with the sound insulating cover 654, so that the sound insulating effect can be provided. In the embodiment shown in FIG. 42, one roller 605 is accommodated in the guide groove 653 in the sheet passage, so that the sound insulating effect can be provided. In these embodiments, sheets of paper are fed through a gap formed between the roller and the upper guide 657.

According to the embodiments described above, when either sheets of continuous-form paper or sheets of cut-form paper are used, the opening portion of the sheet entrance can be substantially completely closed. Therefore, the sound insulating effect can be remarkably enhanced. Since the opening portion of the sheet entrance is completely closed, not only the transmission of sound from the opening can be suppressed but also the vibration of sheets of paper can be suppressed. Accordingly, the generation of noise caused by the vibration of sheets of paper can be prevented, and the sound insulating effect can be more enhanced.

I claim:

1. A method for feeding back a sheet of continuous-form paper used in a paper feed unit including a pin feed means arranged in an upstream of the continuous-form paper feed passage and a friction feed means arranged in a downstream, wherein both the pin feed means and the friction feed means are capable of rotating normally and reversely, a circumferential speed of the friction feed means is a little higher than that of the pin feed means in both the normal and reverse rotation, the method for feeding back a sheet of continuous-form paper comprising the steps of:

setting a first amount of-feed by which a sheet of continuous-form paper is not loosened between the friction feed means and the pin feed means when the sheet of continuous-form paper is fed back by both the friction feed means and the pin feed means and also setting a second amount of feed which is larger than a difference between an amount of feed of the friction feed means and an amount of feed of the pin feed means when the sheet of continuous-form paper is fed back by the first amount of feed;

feeding back the sheet of continuous-form paper by the first amount of feed when both the friction feed means and the pin feed means are simultaneously reversed; and normally rotating only the friction feed means by the second feed amount under the condition that the pin feed means is stopped.

2. The method for feeding back a sheet of continuous-form paper as claimed in claim 1, used in a paper feed unit described in claim 1, wherein the pin feed means and the friction feed means are driven by the same motor, and a mechanism to shut off the rotational transmission from the motor to the pin feed means is provided in a drive force transmission system, the method for feeding back a sheet of continuous-form paper comprising the steps of:

rotating reversely the feed motor by the first amount of feed;

shutting off the rotational transmission of the drive force transmission system;

rotating normally the feed motor by the second amount of feed;

connecting the rotational transmission of the drive force transmission system; and repeating the above motions.

3. A paper feed unit comprising:

a pin feed means arranged in an upstream of the continuous-form paper passage;

a friction feed means arranged in a downstream;

a feed motor capable of rotating normally and reversely;

a rotational transmission means for transmitting the rotation from the feed motor to the pin feed means and the friction feed means in such a manner that a circumferential speed of the friction feed means is a little higher than that of the pin feed means;

a mechanism for shutting off the rotational transmission means from the feed motor to the pin feed means;

a means for setting a first amount of feed by which a sheet of continuous-form paper is not loosened between the friction feed means and the pin feed means when the sheet of continuous-form paper is fed back by both the friction feed means and the pin feed means and also setting a second amount of feed which is larger than a difference between an amount of feed of the friction feed means and an amount of feed of the pin feed means when the sheet of continuous-form paper is fed back by the first amount of feed;

a means for detecting amounts of rotation of the feed motor corresponding to the first and the second amount of feed; and a means for controlling a change-over of the rotational direction of the feed motor and also controlling to shut off and connect the rotational transmission means in such a manner that the feed motor is normally rotated by a rotational amount corresponding to the second amount of feed after the feed motor has been reversely rotated by a rotational amount corresponding to the first amount of feed, and then the transmission means is connected, wherein the above operation is repeatedly conducted.

* * * * *